US009075388B2

(12) United States Patent
Toriyama et al.

(10) Patent No.: US 9,075,388 B2
(45) Date of Patent: Jul. 7, 2015

(54) IMAGE FORMING APPARATUS, CARTRIDGE AND IMAGE FORMING APPARATUS SYSTEM

(71) Applicant: CANON KABUSHIKI KAISHA, Tokyo (JP)

(72) Inventors: Yasunori Toriyama, Numazu (JP); Yuuki Nakamura, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/036,076

(22) Filed: Sep. 25, 2013

(65) Prior Publication Data

US 2014/0086628 A1 Mar. 27, 2014

(30) Foreign Application Priority Data

Sep. 25, 2012 (JP) ..... 2012-210765

(51) Int. Cl.
*G03G 21/18* (2006.01)

(52) U.S. Cl.
CPC ..... *G03G 21/1839* (2013.01); *G03G 21/1842* (2013.01); *G03G 21/1853* (2013.01)

(58) Field of Classification Search
CPC ..... G03G 21/1839; G03G 21/1842
USPC ..... 399/111
See application file for complete search history.

(56) References Cited

U.S. PATENT DOCUMENTS

| | | | | |
|---|---|---|---|---|
| 6,661,977 | B1 | 12/2003 | Kubota | |
| 7,912,404 | B2 * | 3/2011 | Hoshi et al. | 399/111 |
| 8,190,058 | B2 | 5/2012 | Takeyama et al. | |
| 2011/0103835 | A1 | 5/2011 | Hayashi et al. | |
| 2012/0093523 | A1 * | 4/2012 | Kamoshida et al. | 399/12 |

FOREIGN PATENT DOCUMENTS

| | | | |
|---|---|---|---|
| JP | 3658381 | B2 | 3/2005 |
| JP | 4667444 | B2 | 4/2011 |

OTHER PUBLICATIONS

U.S. Appl. No. 14/036,068, filed Sep. 25, 2013.

* cited by examiner

*Primary Examiner* — David Gray
*Assistant Examiner* — Michael Harrison
(74) *Attorney, Agent, or Firm* — Fitzpatrick, Cella, Harper & Scinto

(57) ABSTRACT

A process cartridge detachably mountable to an image forming apparatus includes a contact portion contactable to a first movable member of the apparatus in the process of mounting the cartridge to the image forming apparatus. The contact portion passes the first movable member in the inserting direction, and the first movable member moves from the retracted position to the projection position, and then a second movable member moves from the blocking position to the open position, and the contact portion passes the second movable member in the inserting direction, by which the process cartridge can be mounted to a proper image forming apparatus.

20 Claims, 11 Drawing Sheets

(a)

(b)

IMAGE FORMING APPARATUS, CARTRIDGE AND IMAGE FORMING APPARATUS SYSTEM

FIELD OF THE INVENTION AND RELATED ART

The present invention relates to an image forming apparatus, a cartridge, and an image forming apparatus system, which are for forming an image on recording medium.

Here, an image forming apparatus means an apparatus which forms an image on recording medium, with the use of one of various known image formation principles and methods, such as an electrophotographic process, an electrostatic recording process, and a magnetic recording process. For example, it includes a copying machine, a printer (laser printer, LED printer, etc.), a facsimile machine, a word processor, an image displaying apparatus, (electronic blackboard, electronic whiteboard), etc. Recording medium means an object on which an image can be formed by an image forming apparatus. It includes paper, OHP sheet, secondary transferring member.

A cartridge means a cartridge in which an image bearing member on which an image is formed, and a part or parts of the image forming sections of an image forming apparatus, which has means for processing the image bearing member, are disposed together. It is removably installed in the main assembly of an image forming apparatus, and contributes to the process for forming an image on recording medium. The main assembly of an image forming apparatus is the portion of an image forming apparatus, which remains after the removal of a process cartridge (cartridges) from the image forming apparatus.

An image bearing member is a component on which an image can be formed with the use of one of various image formation principles and methods. For example, an electrophotographic photosensitive component used for an electrophotographic process, a dielectric component used for an electrostatic recording process, a magnetic component used for a magnetic recording process, etc., can be listed as an image bearing member. An image formation process means is a means for processing an image bearing member to form an image on the image bearing member.

Hereinafter, for convenience sake, the present invention is described with reference to an electrophotographic image forming apparatus which employs a cartridge system. Examples of a cartridge are a process cartridge and a development cartridge.

A process cartridge is a cartridge in which an electrophotographic photosensitive member as an image bearing component, and at least one among a charging means, a developing means, and a cleaning means, which are electrophotographic processing means, are disposed together so that they can be removably installed in the main assembly of an image forming apparatus. Hereafter, the main assembly of an electrophotographic image forming apparatus will be referred to simply as apparatus main assembly.

Thus, a process cartridge includes a cartridge in which a developing means as a processing means, and an electrophotographic photosensitive member, are disposed together so that they can be removably installed in the apparatus main assembly, and a cartridge in which an electrophotographic photosensitive member, and a charging means, a developing means or cleaning means as a processing means, are disposed together so that they can be removably installed in the apparatus main assembly.

A process cartridge in which an electrophotographic member and a developing means are disposed together is referred to as a process cartridge of the so-called all-in-one type, whereas a process cartridge in which an electrophotographic photosensitive member and processing means other than a developing means, are disposed together is referred to as a process cartridge of the so-called separation type. Thus, a process cartridge which is used in combination with a development unit having a developing means, to form an image is referred to as a process cartridge of the separation type.

A process cartridge can be installed into, or removed from, the apparatus main assembly by a user him- or herself. Thus, it can make it easier for a user to maintain an electrophotographic image forming apparatus.

A development cartridge has a development roller (developer bearing member for applying developer to electrophotographic photosensitive member). It contains powdery developer (toner) to be used for developing an electrostatic latent image formed on an electrophotographic photosensitive member. It is removably installable in the apparatus main assembly.

In the case of an electrophotographic image forming apparatus which employs a development cartridge, its electrophotographic photosensitive member is attached to the apparatus main assembly, its cartridge supporting member, or the process cartridge of the aforementioned process cartridge of the so-called separation type (which does not have developing means). A development cartridge also is removably installable in the apparatus main assembly. Therefore, it also makes it easier to maintain an electrophotographic image forming apparatus.

That is, a cartridge includes the above-mentioned process cartridge of the so-called all-in-one type, and also, the above-mentioned process cartridges of the so-called separation type. Further, it includes a cartridge which is used in combination with a development cartridge, that is, a process cartridge of the separation type. Further, it includes a cartridge which is used by an electrophotographic image forming apparatus, the electrophotographic photosensitive member of which is attached to the apparatus main assembly, or a cartridge supporting member, and in which a development cartridge is removably installable to process the electrophotographic photosensitive member. Further, it includes a unit which is in the form of a cartridge and is removably installable in the apparatus main assembly to contribute to the image formation process for forming an image on recording medium.

In the case of an image forming apparatus which employs a cartridge system, it is possible that a cartridge which is not compatible with the apparatus will be inserted into the cartridge chamber of the apparatus main assembly, instead of a cartridge which is compatible with the apparatus. In other words, it sometimes occurs that a cartridge is inserted into the main assembly of an image forming apparatus which is incompatible with the cartridge. Hereinafter, a cartridge which perfectly fits in the main assembly of a given electrophotographic image forming apparatus is referred to as a compatible cartridge of the apparatus, whereas a cartridge which does not perfectly fit in the apparatus main assembly of a given image forming apparatus is referred to as an incompatible cartridge for the apparatus.

An incompatible cartridge includes a cartridge which is incompatible in that it is not intended for a given image forming apparatus to which it is going to be inserted. It includes also a cartridge which is compatible in that it is intended for a given image forming apparatus to which it is going to be inserted, but incompatible in that it is going to be inserted into one of the cartridge slots (space) intended for other cartridges in terms of developer color.

One of the methods for preventing the insertion of an incompatible cartridge, such as the one described above, is proposed in Japanese Patent No 3658381. According to this patent, a cartridge is provided with a protective shutter for a photosensitive drum, which is moved by the inward movement of the cartridge into the main assembly of an image forming apparatus. Thus, if an incompatible cartridge is inserted into the main assembly of an image forming apparatus, its protective shutter is opened, and comes into contact with a part of the main assembly shutter, sooner than when a compatible cartridge is inserted. Thus, the incompatible cartridge is prevented from being inserted further into the apparatus main assembly.

There is proposed another method for preventing the insertion of an incompatible cartridge, in Japanese Patent No. 4667444. According to this patent, the main assembly of an image forming apparatus is provided with a regulating member which is movable relative to the apparatus main assembly by a cartridge as the cartridge is inserted into the apparatus main assembly. Further, a cartridge is provided with a movable member. Thus, as an incompatible cartridge is inserted into the image forming apparatus, the movable member of the apparatus main assembly is made to retreat by the movable member of the cartridge to prevent the cartridge from being inserted further into the apparatus main assembly.

In the case of the electrophotographic image forming apparatus disclosed in the first patent, even an incompatible cartridge can be inserted deeply into the cartridge chamber of the apparatus main assembly. Thus, it was sometimes difficult for a user to recognize that the cartridge being inserted is an incompatible one.

In the case of the electrophotographic image forming apparatus disclosed in the specification of the second patent, both the cartridge, and the apparatus main assembly, are provided with a member for preventing the insertion of an incompatible cartridge. Thus, in a case where the erroneous cartridge insertion has to be prevented among multiple image forming apparatuses, which are different in type, and multiple cartridges, which are different in type, the second invention makes an image forming apparatus and the process cartridge therefor excessively complicated in structure, which was likely to result in cost increase.

Further, according to the prior art described above, the movable member(s) has to be disposed at one, or both of, the lengthwise ends the main assembly of the image forming apparatus. Therefore, the prior art is likely to increase an image forming apparatus in length.

SUMMARY OF THE INVENTION

The present invention is one of the results of further development of the above described prior art. Thus, the primary object of the present invention is to provide a combination of an electrophotographic image forming apparatus and a cartridge therefor, which is simple in structure, and yet, ensures that it is only a compatible cartridge that can be installed in the apparatus main assembly.

According to an aspect of the present invention, there is provided an image forming apparatus for forming an image on a recording material, wherein a cartridge is detachably mountable to said image forming apparatus, said image forming apparatus comprising a first movable member movable between a projection position in which said first movable member is in an insertion path of a contact portion provided on said cartridge when said cartridge is mounted to a main assembly of said image forming apparatus, and a retracted position in which said first movable member is retracted from the insertion path, wherein said first movable member moves from the projection position to the retracted position by being contacted by the contact portion; and a second movable member movable between an open position for permitting said cartridge toward downstream with respect to an inserting direction in which said cartridge is mounted to said main assembly and a blocking position for preventing said cartridge from moving toward the downstream by contacting said contact portion, said second movable member being interrelated with said first movable member so that when said first movable member is in the projection position, said second movable member takes the open position, and when said first movable member is in the retracted position, said second movable member takes the blocking position, wherein in the process of mounting said cartridge to said main assembly, said contact portion passes said first movable member in the inserting direction, and said first movable member moves from the retracted position to the projection position, and then said second movable member moves from the blocking position to the open position, and said contact portion passes said second movable member in the inserting direction.

According to another aspect of the present invention, there is provided a process cartridge detachably mountable to a main assembly of an image forming apparatus for forming an image on a recording material, wherein a cartridge is detachably mountable to the image forming apparatus, the main assembly of the image forming apparatus including, a first movable member movable between a projection position in which said first movable member is in an insertion path of a contact portion provided on said cartridge when said cartridge is mounted to the main assembly of said image forming apparatus, and a retracted position in which first movable member is retracted from the insertion path, wherein said first movable member moves from the projection position to the retracted position by being contacted by the contact portion; and a second movable member movable between an open position for permitting said cartridge toward downstream with respect to an inserting direction in which said cartridge is mounted to said main assembly and a blocking position for preventing said cartridge from moving toward the downstream by contacting said contact portion, said second movable member being interrelated with said first movable member so that when said first movable member is in the projection position, said second movable member takes the open position, and when said first movable member is in the retracted position, said second movable member takes the blocking position; said process cartridge comprising a contact portion contactable to the first movable member in the process of mounting said cartridge to said main assembly, wherein said contact portion passes said first movable member in the inserting direction, and said first movable member moves from the retracted position to the projection position, and then said second movable member moves from the blocking position to the open position, and said contact portion passes said second movable member in the inserting direction.

According to a further aspect of the present invention, there is provided an image forming apparatus system for forming an image on a recording material, said image forming apparatus system comprising (i) a first cartridge; (ii) a first image forming apparatus for forming an image on a recording material, wherein the first cartridge is detachably mountable to said first image forming apparatus, said first image forming apparatus including a first movable member movable between a projection position in which said first movable member is in an insertion path of a first contact portion provided on said first cartridge when said first cartridge is mounted to a first main assembly of said first image forming apparatus, and a retracted position in which said first movable member is retracted from the insertion path, wherein said first movable member moves from the projection position to the retracted position by being contacted by the first contact portion; a second movable member movable between an open position for permitting said first cartridge toward downstream with respect to an inserting direction in which said first cartridge is mounted to said first main assembly and a blocking position for preventing said first cartridge from moving toward the downstream by contacting said first contact portion, said second movable member being interrelated with said first movable member so that when said first movable member is in the projection position, said second movable member takes the open position, and when said first movable member is in the retracted position, said second movable member takes the blocking position; wherein in the process of mounting said first cartridge to said first main assembly, said first contact portion passes said first movable member in the inserting direction, and said first movable member moves from the retracted position to the projection position, and then said second movable member moves from the blocking position to the open position, said first contact portion passes said second movable member in the inserting direction; (iii) a second cartridge; and (iv) a second image forming apparatus for forming an image on a recording material, wherein the second cartridge is detachably mountable to said second image forming apparatus, said second image forming apparatus including a third movable member movable between a projection position in which said third movable member is in an insertion path of a second contact portion provided on said second cartridge when said second cartridge is mounted to a second main assembly of said second image forming apparatus, and a retracted position in which third movable member is retracted from the insertion path, wherein said third movable member moves from the projection position to the retracted position by being contacted by the second contact portion; a fourth movable member movable between an open position for permitting said second cartridge toward downstream with respect to an inserting direction in which said second cartridge is mounted to said second main assembly and a blocking position for preventing said second cartridge from moving toward the downstream by contacting said second contact portion, said fourth movable member being interrelated with said third movable member so that when said third movable member is in the projection position, said fourth movable member takes the open position, and when said third movable member is in the retracted position, said fourth movable member takes the blocking position; wherein in the process of mounting said second cartridge to said second main assembly, said second contact portion passes said third movable member in the inserting direction, and said third movable member moves from the retracted position to the projection position, and then said fourth movable member moves from the blocking position to the open position, said second contact portion passes said fourth movable member in the inserting direction, wherein when said second cartridge is mounted to said first image forming apparatus, said second movable member taking the blocking position contacts said contact portion before said second contact portion passes said first movable member in the inserting direction, and when said first cartridge is mounted to said second image forming apparatus, said fourth movable member taking the blocking position contacts said contact portion before said first contact portion passes said third movable member in the inserting direction.

Further features of the present invention will become apparent from the following description of exemplary embodiments (with reference to the attached drawings).

DESCRIPTION OF THE PREFERRED EMBODIMENTS

Hereinafter, the present invention is described in detail with reference to the embodiments of the present invention, and the appended drawings.

Embodiment 1

Figure 3:
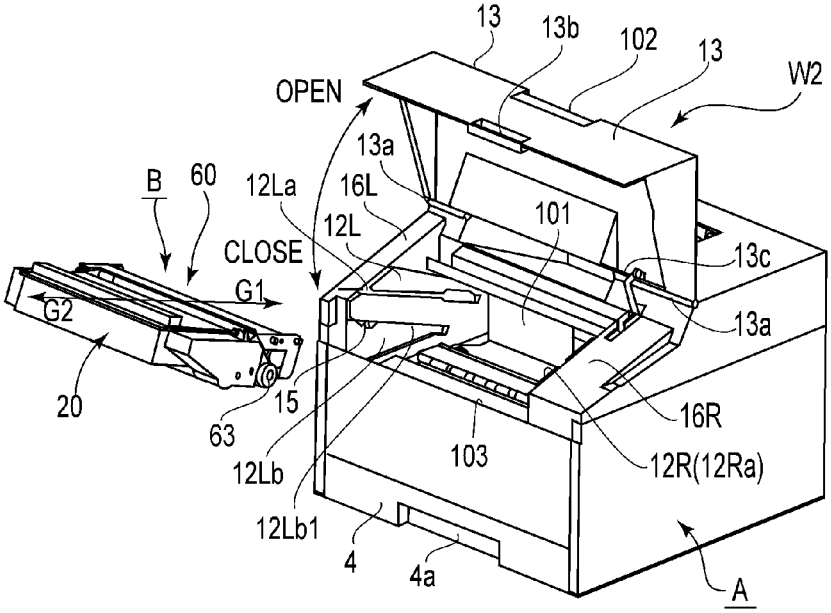
FIG. 3 is a perspective view of a combination of the apparatus main assembly and one of the cartridges removably installable in the apparatus main assembly, in the first embodiment, when the main door of the apparatus main assembly is open, and the cartridge is positioned to be inserted into the apparatus main assembly.
Figure 4:
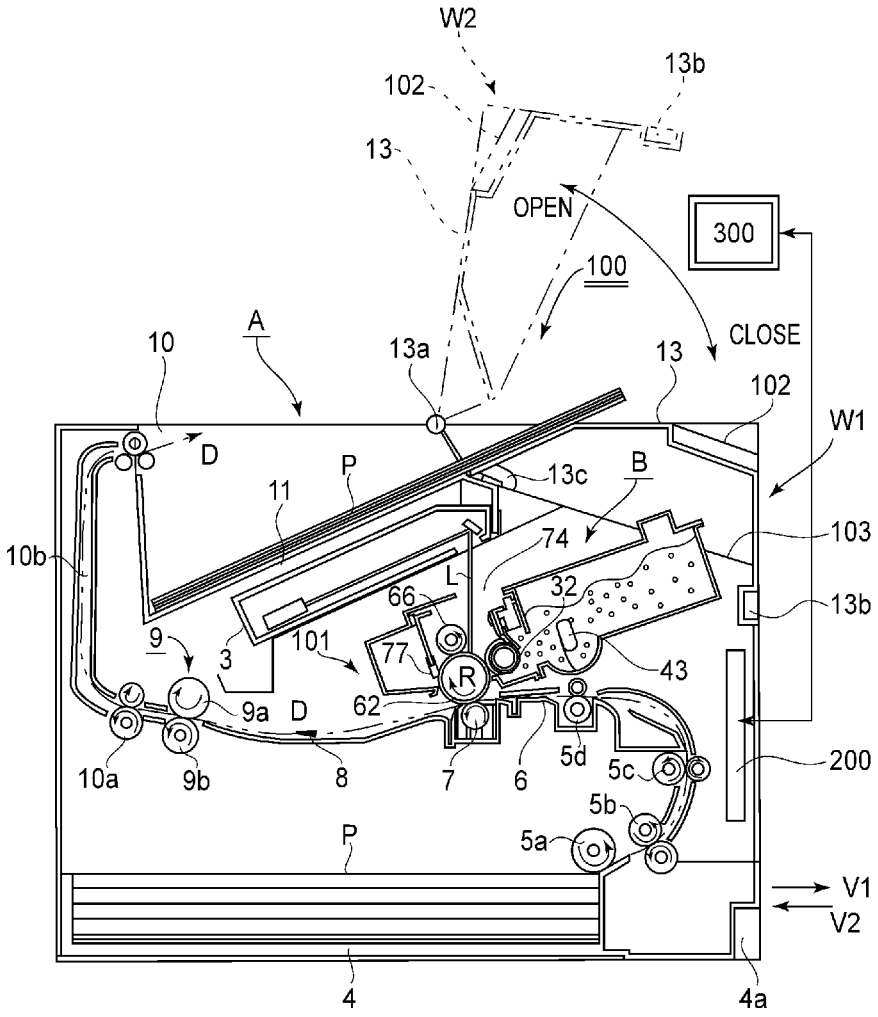
FIG. 4 is a schematic sectional view of the image forming apparatus, at a vertical plane parallel to the direction in which the cartridge is inserted into the apparatus main assembly, as seen from the left side of the apparatus.

(1) General Description of Typical Image Forming Apparatus to which Present Invention is Applicable FIG. 21 is a perspective view of the image forming apparatus 100 in this embodiment, and FIG. 3 is a perspective view of a combination of the apparatus main assembly A, and a cartridge B removably installable in the apparatus main assembly A, when the door 13 of the apparatus main assembly A is open. FIG. 4 is a sectional view of the image forming apparatus 100, at a vertical plane parallel to the direction in which the cartridge B is removably inserted into the apparatus main assembly A, as seen from the left side of the apparatus main assembly.

The image forming apparatus 100 in this embodiment is an electrophotographic laser printer (electrophotographic image forming apparatus) which employs a cartridge system. It forms an image on a sheet P of recording medium (which hereafter may be referred to simply as sheet P) with the use of an electrophotographic image formation process. It can form an image which reflects electrical information of an image to be formed, which is inputted into the control circuit (controlling means) 200 of the image forming apparatus 100, from an external host apparatus 300 (FIG. 4) such as a personal computer.

A referential code 102 stands for the control panel of the image forming apparatus 100, through which various information such as image formation conditions can be inputted into the control section 200. The control panel 102 has a display across which various information is displayed. In this embodiment, the control section 102 is a part of the door 13 of the apparatus main assembly A.

Regarding the direction of the image forming apparatus 100, the front side (user side) of the apparatus 100 means the side from which a sheet tray 4 in which multiple sheets P can be stored in layers can be roughly horizontally inserted into, or moved out of, the apparatus main assembly A. The back (rear) side of the image forming apparatus 100 means the opposite side of the image forming apparatus 100 from the front side. The left and right sides of the image forming apparatus 100 are the left and right sides as seen from the front side of the apparatus 100. The top and bottom sides of the image forming apparatus 100 are the top and bottom sides with reference to the gravity direction. The main assembly A of the image forming apparatus 100 (which hereafter is referred to as apparatus main assembly A) is the assembly of the structural components of the image forming apparatus 100, minus the cartridges B.

Regarding the direction of the cartridge B, and its structural components, in this embodiment, their lengthwise direction is such a direction that is parallel to the axial line of the electrophotographic photosensitive drum 62 as the image bearing member. It is the direction perpendicular to the directions indicated by arrow marks G1 and G2 (FIG. 3) in which the cartridge B is inserted into, or moved out of, the apparatus main assembly A. Its widthwise direction means such a direction that is parallel to the directions indicated by the arrow marks G1 and G2, in which the cartridge B is inserted into, or moved out of, the apparatus main assembly 100A. The front side of the cartridge B means the upstream surface of the cartridge B in terms of the direction in which the cartridge B is inserted into the apparatus main assembly A. The back side of the cartridge B means the opposite side of the cartridge B from the front side (downstream side in terms of direction G1 in which cartridge B is inserted into apparatus main assembly A). The left and right sides of the cartridge B are the left and right sides as seen from the front side of the cartridge B.

Referring to FIG. 4, a substantial space, which is roughly in the center of the apparatus main assembly A, is the cartridge chamber 101, that is, the space into which the cartridge B is removably installed. The cartridge B in this embodiment is a process cartridge of the so-called all-in-one type, which will be described later in detail. That is, it has an electrophotographic photosensitive drum 62 (which hereafter is referred to simply as drum) as an image bearing member on which an image is formed, and processing means, more specifically, a charging means 66, a developing means 32, and a cleaning means 77, which are for processing the drum 62.

In this embodiment, the charging means 66 is in the form of a roller (charge roller: electrically conductive elastic roller). The developing means 32 also is in the form of a roller (development roller). It is of the so-called no-contact-development type. It uses single-component magnetic toner as developer. The cleaning means 77 is in the form of a blade (cleaning blade).

It is only when the cartridge B is in the preset image formation positions of the cartridge chamber 101 of the apparatus main assembly A that the image forming apparatus 100 can perform an image forming operation. That is, when the image forming apparatus 100 can form an image, the driving force receiving section 63 of the cartridge B is in engagement with the driving force outputting section (unshown) of the apparatus main assembly A. Thus, the driving force from the cartridge driving system (unshown) of the apparatus main assembly A is transmitted to the cartridge B, making it possible for the rotational components such as the drum 62, development roller 32, developer conveying member 43, etc., to be rotationally driven. In the case of the image forming apparatus 100 in this embodiment, the right-hand side of the apparatus main assembly A, and the right-hand side of the cartridge B, are referred to as the drive side, whereas the left-hand sides are referred to as the non-drive side.

Further, the electrical contacts (unshown) of the cartridge B are electrically in contact with the electrical contacts (unshown) of the apparatus main assembly A. Thus, bias can be applied to the bias receiving members, such as the charge roller 66, development roller 32, etc., of the cartridge B from the electric power supply section (unshown) of the apparatus main assembly A.

The apparatus main assembly A is provided with a laser scanner unit 3 as an exposing apparatus (exposing means), which is above the cartridge chamber 101. This unit 3 outputs a beam L of laser light while modulating the beam L with the electrical information of the image to be formed, which is inputted into the control circuit 200 from the external host apparatus 300. The beam L of laser light enters the cartridge B through the exposure window 74, with which the top wall of the cartridge B is provided, and scans (exposes) the peripheral surface of the drum 62. The downwardly facing area of the peripheral surface of the drum 62 is in contact with the peripheral surface of a transfer roller (transferring means) 7, forming a transfer nip. The transfer roller 7 is an electrically conductive elastic roller, to which a preset transfer bias is applied.

Figure 2:
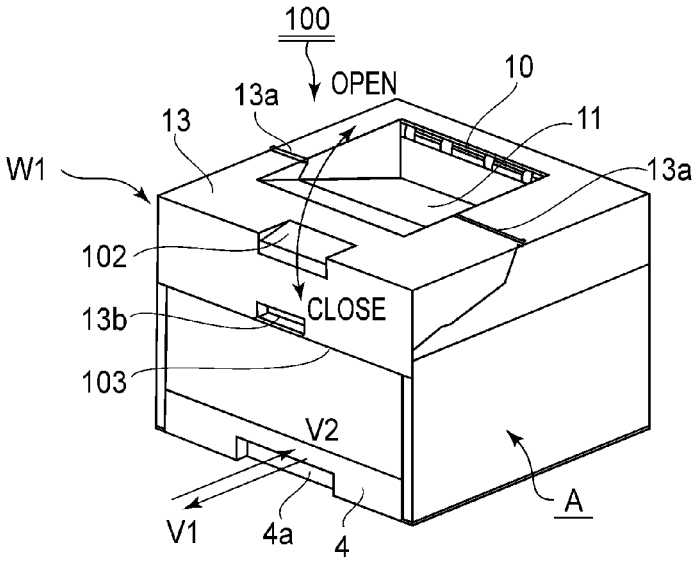
FIG. 2 is a perspective view of the image forming apparatus in the first embodiment.

Further, the apparatus main assembly A is provided with a sheet tray 4, which is below the transfer roller 7, and in which multiple sheets P of recording medium are storable. This tray 4 can be roughly horizontally inserted into, or moved out of, the apparatus main assembly A, from the front side of the image forming apparatus 100 (front loading). That is, the tray 4 can be pulled out of the apparatus main assembly A, like a drawer, toward a user so that it can be replenished with sheets P of recording medium. Obviously, the tray 4 can be pushed back into its preset position in the apparatus main assembly A. Referring to FIGS. 2 and 4, the directions indicated by arrow marks V1 and V2 are the directions in which the tray 4 can be pulled out of the apparatus main assembly A, and pushed into the apparatus main assembly A, respectively. A component designated by a referential code 4*a* is a handhold with which the front wall of the tray 4 is provided.

Further, the apparatus main assembly A is provided with a pickup roller 5*a*, a pair of retard rollers 5*b*, a pair of recording medium conveyance rollers 5*c*, a pair of registration rollers 5*d*, and a transfer front guide 6, which are disposed in the listed order, on the front side of the apparatus main assembly A. These components make up the sheet conveyance passage which extends from the tray 4 to the transfer roller 7.

Further, the apparatus main assembly A is provided with a fixing device (fixing means) 9, which is made up of a heat roller 9*a* and a pressure roller 9*b*, and is in the deeper end portion of the apparatus main assembly A. There is disposed a sheet guide 8 between the transfer roller 7 and fixing device 9. There are also disposed a pair of recording medium conveyance rollers 10*a* and a sheet conveyance passage 10*b*, on the rear side of the fixing device 9, in the apparatus main assembly A. The recording medium conveyance passage 10*b* extends upward from the pair of recording medium conveyance rollers 10*a*. A part of the top surface of the apparatus main assembly A is utilized as a delivery tray 11.

The image forming operation of the image forming apparatus 100 in this embodiment is as follows: The control circuit 200 starts up the driving force generating section in response to a printing operation start signal, whereby the drum 62 begins to be rotationally driven in the clockwise direction, indicated by an arrow mark R in FIG. 4, at a preset peripheral velocity (process speed), and the laser scanner unit 3, development roller 32, developer conveying member 43, transfer roller 7, fixing device 9, etc., also begin to be driven in the preset directions and/or speeds. The charge roller 66 is rotated by the rotation of the drum 62. To the charge roller 66, a preset charge bias is applied from the power supply section, whereby the peripheral surface of the drum 62 is uniformly charged to preset polarity and potential level.

The uniformly charged area of the peripheral surface of the drum 62 is scanned by (exposed to) the beam L of laser light outputted from the laser scanner unit 3 while being modulated with the image formation signals. Consequently, an electrostatic image, which reflects the exposure pattern is formed on the peripheral surface of the drum 62. This electrostatic image is developed by the development roller 32 into a toner image (developer image), and is moved into the transfer nip, which is between the drum 62 and transfer roller 7.

Meanwhile, the pickup roller 5*a* begins to be driven with a preset control timing, in synchronism with the timing with which the beam L of laser light is outputted. Thus, the sheets P in the sheet tray 4 are pulled out of the tray 4, one by one, by the pair of retard rollers 5*b*, and are conveyed further into the apparatus main assembly A. Then, each sheet P is conveyed further by the pair of conveyance rollers 5*c*, and pair of registration rollers 5*d*, so that it will be introduced into the transfer nip with a preset control timing. Then, the sheet P is conveyed through the transfer nip while remaining pinched by the drum 62 and transfer roller 7. While the sheet P is conveyed through the transfer nip, a preset transfer bias is applied to the transfer roller 7 from the power supply section, whereby the toner image on the drum 62 is transferred onto the surface of the sheet P as if it is peeled away from the drum 62.

After being conveyed through the transfer nip, the sheet P is separated from the peripheral surface of the drum 62, and is introduced into the fixing device 9 by the conveyance guide 8. After the separation of the sheet P from the peripheral surface of the drum 62, the transfer residual toner is removed by the cleaning blade 77 (peripheral surface of drum 62 is cleaned), so that it can be repeatedly used for image formation.

As the sheet P is introduced into the fixing device 9, it is conveyed through the fixation nip while remaining pinched by the drum 62 and transfer roller 7 and being subjected to heat and pressure. Thus, the unfixed toner image becomes fixed as a permanent image, to the surface of the sheet P. After being conveyed out of the fixing device 9, the sheet P is conveyed further by the pair of conveyance rollers 10*a*, sheet conveyance passage 10, and pair of discharge rollers 10, in the listed order. Then, it is discharged, as a permanent print, onto the delivery tray 11. An arrow mark D indicates the direction (recording medium conveyance direction) in which the sheet P is conveyed.

(2) Cartridge

Figure 5:
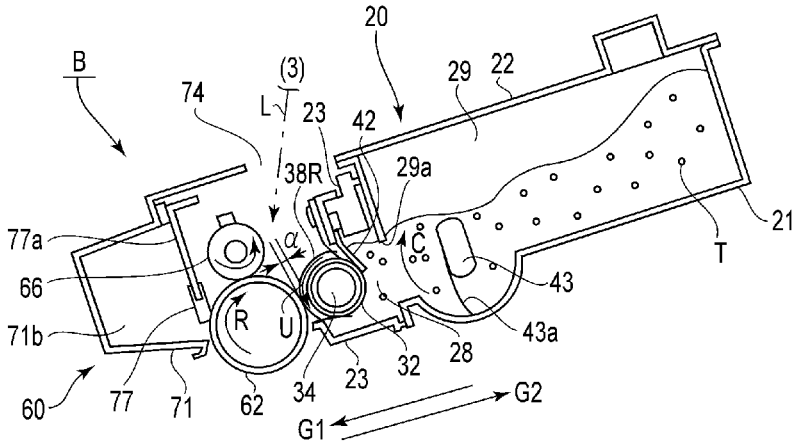
FIG. 5 is an enlarged view of the cartridge portion of FIG. 4.
Figure 6:
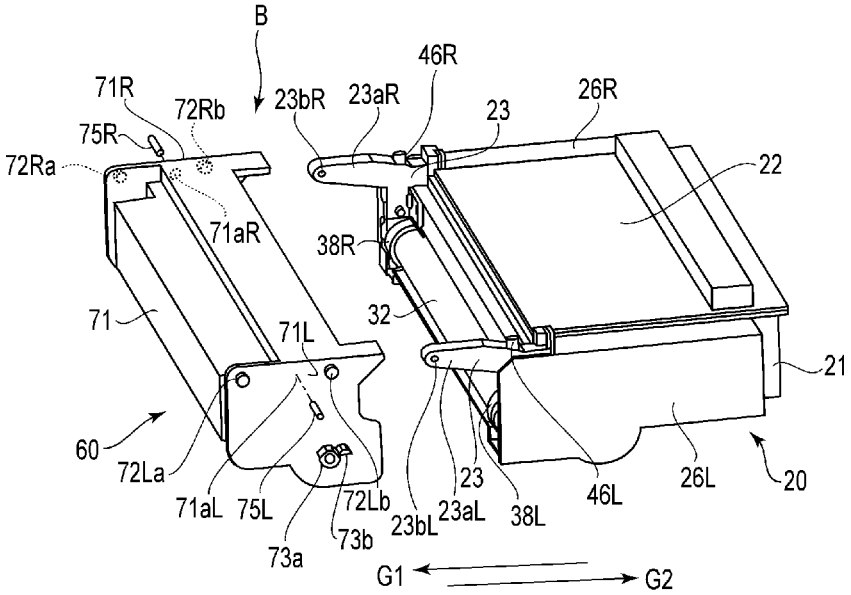
FIG. 6 is a partially exploded view of the cartridge; the cleaning unit and development unit are not in connection to each other.

Next, referring to FIGS. 5 and 6, the structure of the cartridge B is described. FIG. 5 is an enlarged view of the cartridge portion of FIG. 4. The cartridge B in this embodiment is of the so-called all-in-one type, which is a united combination of a cleaning unit 60 and development unit 20. FIG. 6 is a perspective view of the combination of the cleaning unit 60 and development unit 20 when the cleaning unit 60 and development 20 are not in connection to each other.

The cleaning unit 60 has a cleaning unit frame 71, the lengthwise direction of which is parallel to the left/right direction of the apparatus main assembly A. It is to this frame 71 that the drum 62, as an image bearing member, on which an image is formed, the charge roller 66 and cleaning blade 77, as means for processing the drum 62, are attached.

The drum 62 is disposed between the left and right plates 71L and 71R of the frame 71, being rotatably supported by the left and right plates 71L and 71R with the placement of a pair of bearings between the lengthwise left and right ends of the drum 62 and the left and right plates 71L and 71R, respectively.

The charge roller 66 is disposed on the top side of the drum 62, being in parallel to the drum 66. It also is disposed between the left and right plates 71L and 71R, being rotatably supported by the left and right plates 71L and 71R, with the placement of a pair of the bearings between the left and right ends of the charge roller 66 and plates 71L and 71R, respectively. Further, the charge roller 66 is kept pressed upon the peripheral surface of the drum 62 by a preset amount of pressure generated by a pair of pressing members (unshown).

The cleaning blade 77 is an elastic blade. It is fixed to a preset portion of the waste toner chamber 71*b* of the frame 71, with the placement of a rigid blade supporting member 77*a*, which is made of a metallic substance or the like, between the actual blade portion of the cleaning blade 77 and the frame 71. The blade 77 is disposed in such an attitude that its cleaning edge is on the upstream side of the blade supporting member 77*a*, in terms of the rotational direction of the drum 62 indicated by the arrow mark R. It is kept pressed on the peripheral surface of the drum 62 so that a preset amount of contact pressure is maintained between the cleaning edge of the cleaning blade 77 and the peripheral surface of the drum 62.

The development unit 20 in this embodiment is a developing device of the non-contact type. It uses single-component magnetic toner as developer T. This unit 20 is an assembly made up of a toner container 21, a top cover 22, a development chamber 23, a development blade 42, a development roller 32, a magnetic roller 34, a developer conveying member 43, a left (first) side cover 26L, a right (second) side cover 26R, a pair of pressure applying members 46L and 46R, etc.

The single-component magnetic toner T as developer is stored in the toner chamber 29 made up of the toner container 21, top cover 22, first side cover 26L and second side cover 26R. The development chamber 23 is in connection to the toner chamber 29 through an opening 29*a*. The developer conveying member 43 is disposed in the toner chamber 29. It is rotationally driven in the clockwise direction, indicated by an arrow mark C in FIG. 5.

The development roller 32 is disposed in the development chamber 23. It is a hollow roller (sleeve). It is rotatably supported between the first (left) and second (right) side covers 26L and 26R, with the placement of a pair of bearings between the lengthwise ends of the development roller 32, and the first and second side covers 26L and 26R, respectively. The left and right ends of the development roller 32 are fitted with a pair of spacer rings 38L and 38R, as space maintaining members, respectively, which are concentric with the development roller 32. The spacer rings 38L and 38R are the same in external diameter. They are greater in external diameter than the development roller 32.

There is concentrically disposed a stationary magnetic roller (fixed magnet) 34 in the hollow of the development roller 32. The development blade 42 is fixed to the wall of the development chamber 23 by its base portion. It is an elastic member, and is placed in contact with the peripheral surface of the development roller 32 in such an attitude that the portion of the development blade 42, which is adjacent to the opposite lengthwise edge from the base portion, presses on the peripheral surface of the development roller 32. It is a member for regulating in thickness the layer of toner borne on the peripheral surface of the development roller 32. It is positioned so that the portion of its peripheral surface, which is on the opposite side from the opening 29*a* of the toner chamber 29, is exposed from the development chamber 23.

The cleaning unit 60 and development unit 20 are connected to each other by the left and right connective members 75L and 75R in such a manner that the two units 60 and 20 are rotationally movable about the connective members 75L and 75R. To describe in detail this connection between the two units 60 and 20 with reference to FIG. 6, the left and right ends of the development roller container 23 are provided with left and right arms 23*a*L and 23*a*R, which are provided with cylindrical holes 23*b*L and 23*b*R, respectively, which are parallel to the rotational axis of the development roller 32. As for the cleaning device frame 71, its left and right plates 71L and 71R are provided with left and right holes 71*a*L and 71*a*R, through which the left and right connective members 75L and 75R are put, respectively.

Thus, all that is necessary to connect the cleaning unit 60 and development unit 20 to each other is to position the two units 60 and 20 in such a manner that the holes 23*b*L and 23*b*R of the left and right arms 23*a*L and 23*a*R of the cleaning unit 60 align with the left and right holes 71*a*L and 71*a*R of the cleaning unit frame 71, and put the left and right connective members 75L and 75R through the holes 23*b*L and 23*b*R, and the holes 71*a*L and 71*a*R, respectively. The holes are positioned so that after the connection of the two units 60 and 20 to each other, the left and right connective members 75L and 75R are in alignment with each other in terms of the lengthwise direction.

Since the cleaning unit 60 and development unit 20 are connected to each other as described above, the cleaning unit 60 and development unit 20 are rotationally movable about the connective members 75L and 75R.

As the cleaning unit 60 and development unit 20 are connected to each other as described, the left and right pressure applying members (coil springs) 46L and 46R attached to the base portions of the left and right arms 23*a*L and 23*a*R are pressed upon the cleaning unit frame 71. Thus, the resiliency of these pressure applying members 46L and 46R acts in the direction to rotationally move the development unit 20 about the left and right connective members 46L and 46R. Thus, the development unit 20 is kept pressed toward the cleaning unit 60.

Therefore, it is ensured that the left and right spacer rings 38L and 38R of the development roller 32 are kept pressed upon the peripheral surface of the left end portion of the drum 62, and that of the right end portion of the drum 62, respectively, providing thereby a preset amount of gap a between the peripheral surface of the development roller 32 and the peripheral surface of the drum 62. The aforementioned exposure window 74 is between the cleaning unit 60 and development unit 20.

When the cartridge B is in its preset image formation position in the cartridge chamber 101, the cleaning unit 60 of the cartridge B is kept pressed on the cartridge positioning section of the apparatus main assembly A by the cartridge positioning mechanism (unshown) of the apparatus main assembly A. Thus, the cartridge B is kept precisely positioned relative to the apparatus main assembly A, with the driving force receiving section 63 (FIG. 3) of the cartridge B being in engagement with the driving force output section (unshown) of the apparatus main assembly A, and also, the electrical contacts (unshown) of the cartridge B being electrically in contact with the electrical contacts (unshown) of the apparatus main assembly A. It is when the image forming apparatus 100 is in the above described state that the image forming apparatus 100 is ready for image formation.

That is, the drum 62 is rotationally driven in the clockwise direction indicated by the arrow mark R in FIG. 5 at the preset speed, and the charge roller 66 is rotated by the rotation of the drum 62. The development roller 32 is rotationally driven around the magnetic roller 34 in the counterclockwise direction indicated by an arrow mark U at a preset speed. To the charge roller 66 and development roller 32, preset charge bias and development bias, respectively, are applied with preset control timings.

The developer conveying member 43 is rotationally driven in the clockwise direction indicated by an arrow mark C at a preset speed. As the developer conveying member 43 is rotated, the toner T in the toner chamber 29 is conveyed by a sheet (paddle) 43*a*, with which the developer conveying member 43 is provided, into the toner supplying chamber 28 in the development roller container 23, through the opening 29*a*. The sheet 43*a* is made of flexible substance such as PPS, PC, PET, etc., and conveys the toner T while stirring the toner T.

As the toner T is conveyed into the toner supplying chamber 28, a part of the body of the toner T in the chamber 28 is borne on the peripheral surface of the development roller 32 by the magnetic force of the magnetic roller 34, and is conveyed toward the drum 62 by the rotation of the development roller 32. While the layer of the toner T on the peripheral surface of the development roller 32 is conveyed toward the drum 62, it is regulated in thickness by the development blade 42. Then, the layer of the toner T, which has been regulated in thickness, is conveyed further by the further rotation of the development roller 32, to the development area, that is, the area in which the peripheral surface of the development roller 32 directly faces the peripheral surface of the drum 62, in which it is used for the development of the electrostatic image on the drum 62. The toner which remained in the layer of the toner T after the development of the electrostatic latent image is returned to the toner supplying chamber 28 by the subsequent rotation of the development roller 32. Then, the development roller 32 is supplied again with the toner in the toner supplying chamber 28.

After the transfer of the toner image on the drum 62 onto the sheet P of recording medium, the toner remaining on the peripheral surface of the drum 62 is removed by the cleaning blade 77, and the drum 62 is used again for image formation process. The toner removed from the drum 62 is stored in the waste toner storage chamber 71*b* of the cleaning unit 60.

(3) Cartridge Replacement Method

As the cartridge B is used for image formation, the developer (toner) T stored in the development unit 20 is consumed.

Thus, the cartridge B is provided with a means (unshown) for detecting the amount of the residual developer in the cartridge B. The detected amount of the residual developer is compared by the control circuit 200 with a threshold value preset for warning a user of the estimated length of the residual life of the cartridge B, or the arrival of the end of the service life of the cartridge B. If the control circuit 200 determines that the amount of the residual developer in the cartridge B is no more than the threshold value, it shows on the display of the control panel 102, the estimated length of the residual service life of the cartridge B, or the message which informs a user of the arrival of the end of the service life of the cartridge B, prompting thereby the user to prepare a replacement cartridge B, or replace the cartridge B in the apparatus main assembly A, so that the image forming apparatus 100 remains at a preset level in terms of image quality.

The aforementioned door 13, with which the front side of the apparatus main assembly A of the image forming apparatus 100 in this embodiment is provided, is given such a shape and a size that as it is opened, it can expose roughly top half of the front side of the apparatus main assembly A, and roughly front half of the top side of the apparatus main assembly A. The door 13 is hinged to the apparatus main assembly A so that it can be rotationally opened or closed about the hinge (center of rotation) 13*a*. More specifically, the door 13 can be locked in a horizontal position W1, in which it remains (when it is completely closed) as shown in FIGS. 2 and 4, and in an upright position W2, in which it will remain as it is opened up and rearward, as seen from the front side, as shown in FIG. 3.

When the door 13 is in its closed position W1, it is kept locked by a locking means (unshown). Thus, when it is necessary for a user to unlock the door 13, the user is to place his or her finger on the handhold 13*b* of the door 13, and move a lock releasing member, with which the hand hold 13*b* is provided, so that the door 13 is unlocked. With the door 3 unlocked, the door 3 can be moved from its closed position W1 to its open position W2. In this embodiment, in order for the cartridge B in the apparatus main assembly A to be replaced, the door 13 has to be wide open as shown in FIG. 3.

As the door 13 is moved from the closed position W1 to the open position W2, it is held upright in the open position W2 by a door holder 3*c*. Consequently, an opening 103, which extends across roughly the top half of the front side of the apparatus main assembly A (that is, roughly front half of top side of apparatus main assembly A), becomes exposed as shown in FIG. 3. This opening 103 is large enough to allow the cartridge B to pass when the cartridge B is inserted into, or extracted from, the apparatus main assembly A.

When the door 3 is open, and the cartridge B is in its image formation position in the cartridge chamber 101 of the apparatus main assembly A, the front side of the cartridge B (development unit side) remains exposed through the opening 103. When the cartridge B is not in the cartridge chamber 101, the cartridge chamber 101 is visible (FIG. 3).

As the door 13 is moved from its closed position W1 to its open position W2 when the cartridge B is in the cartridge chamber 101, the cartridge B is unlocked from the preset cartridge position by a mechanism (unshown) which is driven by the movement of the door 13. Further, the driving force receiving section 63 of the cartridge B is disengaged from the driving force output section of the apparatus main assembly A by the mechanism. Thus, it becomes possible for the cartridge B to be extracted from the cartridge chamber 101.

Figure 8:
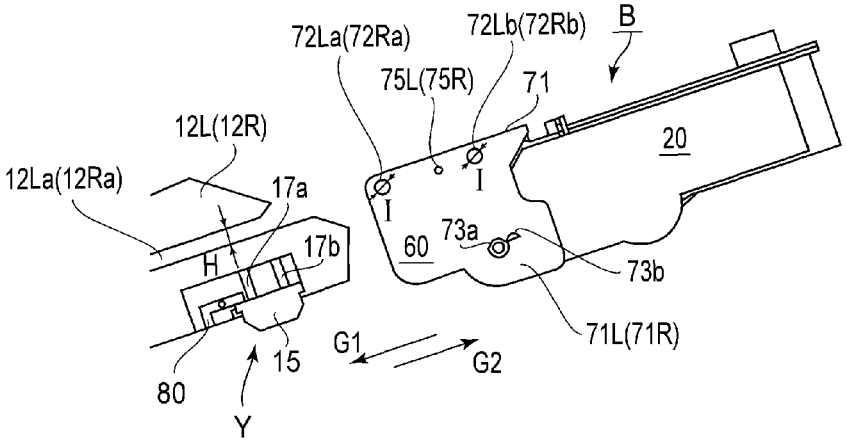
FIG. 8 is a drawing for describing how the cartridge is to be inserted, or removed from, the apparatus main assembly.

Referring to FIGS. 6 and 8, the cartridge B is provided with a pair of insertion-extraction guide bosses 72La and 72Lb (by which cartridge is guided), and a pair of insertion-extraction guide bosses 72Ra and 72Rb, which are on the outward surface of the left plate 71L of the cleaning unit frame 71, and the outward surface of the right plate 71R of the cleaning unit frame 71, respectively. The two pairs of guide bosses are symmetrically disposed in terms of the lengthwise direction of the cartridge B.

In this embodiment, in terms of the direction G1 in which the cartridge B is inserted into the apparatus main assembly A, the insertion-extraction guide bosses 72La (72Ra) and 72Lb (72Rb) are the upstream and downstream bosses, respectively. They are aligned in the cartridge insertion direction G1, with the provision of a preset distance between the two guide bosses 72La (72Ra) and 72Lb (72Rb).

Figure 7:
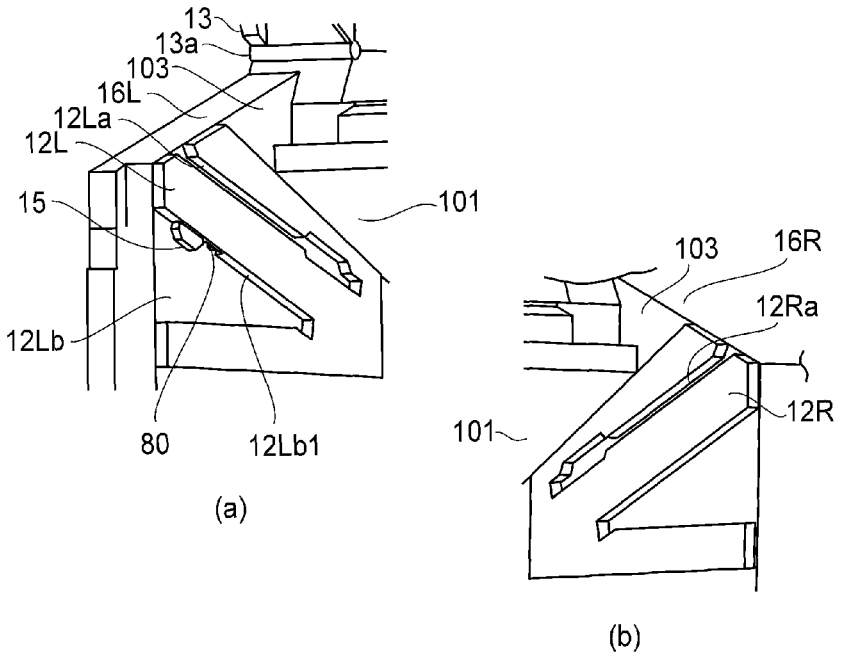
FIG. 7(*a*) is a perspective view of the cartridge guiding left member of the apparatus main assembly, its adjacencies, of the cartridge chamber, and FIG. 7(*b*) is a perspective view of the cartridge guiding right member, and its adjacencies, of the cartridge chamber.

Referring to FIGS. 7(*a*) and 7(*b*), the apparatus main assembly A is provided with cartridge guiding left and right members 12L and 12R, which are on the inward side of the left and right plates 16L and 16R of the cartridge chamber 101, respectively, being symmetrically positioned in terms of the direction perpendicular to the cartridge insertion direction G1. As seen from the front side of the apparatus main assembly A, the guiding members 12L and 12R extend diagonally downward. These cartridge guiding members 12L and 12R are provided with a pair of grooves 12La and 12Ra, respectively, which are symmetrically positioned in terms of the left/right direction of the apparatus main assembly A. As seen from the front side of the apparatus main assembly A, they also extend diagonally downward.

Next, referring to FIG. 8, the width H of each of the guiding groove 12La and 12Ra is slightly greater than the diameter I of each of the insertion-extraction guide bosses 72La, 72Lb, 72Ra and 72Rb of the cartridge B.

When the cartridge B is in its image formation position in the cartridge chamber 101, the insertion-extraction left guide bosses 72La and 72Lb are in engagement with the guiding groove 12La of the cartridge guiding left member 12L, and the insertion-extraction right guide bosses 72Ra and 72Rb of the cartridge B are in engagement with the cartridge guiding groove 12Ra of the cartridge guiding right member 12R. That is, the guide bosses 72La and 72Lb are guided by the groove 12La, whereas the guide bosses 72Ra and 72Rb are guided by the groove 12Ra.

The operation to be performed to extract the cartridge B from the cartridge chamber 101 of the apparatus main assembly A is as follows. First, a user (operator) is to grasp the front side, that is, the development unit side, of the cartridge B, which is exposed through the opening 103. Then, the user is to move the cartridge B in the cartridge extraction direction indicated by the arrow mark G2 in FIG. 8, while allowing the left insertion-extraction guide bosses 72La and 72Lb, and right insertion-extraction guide bosses 72Ra and 72Rb, to follow the guiding groove 12La of the left guiding member 12L, and the guiding groove 12Ra of the right guiding member 12R, respectively, until the cartridge B comes out of the apparatus main assembly A.

The operation to be performed to install the cartridge B into the cartridge chamber 101 of the apparatus main assembly A is as follows. First, the user (operator) is to grasp the development unit side of the cartridge B, and insert the cartridge B into the cartridge chamber 101 through the opening 103, while holding the cartridge B so that the cartridge B enters the cartridge chamber 101 from the cleaning unit side. Then, the user is to engage the left insertion-extraction guide bosses 72La and 72Lb, and right insertion-extraction guide bosses 72Ra and 72Rb, into the guiding grooves 12La and 12Ra of the cartridge guiding left and right guiding members 12L and 12R, respectively.

Then, the user is to move the cartridge B further into the apparatus main assembly A in the cartridge insertion direction indicated by the arrow mark G2, while allowing the left pair of insertion-extraction guide bosses 72La and 72Lb, and the right pair of insertion-extraction guide bosses 72Ra and 72Rb, to remain engaged in the guiding groove 12La of the left guiding member 12L, and the guiding groove 12R of the right guiding member 12R, respectively. In other words, the movement of the left pair of insertion-extraction guide bosses 72La and 72Lb, and the right pair of insertion-extraction guide bosses 72Ra and 72Rb, is regulated by the guiding grooves 12La and 12Ra. Therefore, the cartridge B is kept in the proper attitude. The cartridge B is to be inserted until its inward movement is regulated by a regulating section (unshown).

Then, the door 3 is to be rotationally moved about the hinge 13*a* from the open (upright) position W2 to the closed (horizontal) position W1, against the resiliency of the door holding member 13*c*. As the door 3 is moved into the closed position W1, it is locked in the closed position W1 by the locking means. While the door 3 is moved from the open (upright) position W2 to the closed (horizontal) position W1, the mechanism for positioning the cartridge B is made to operate by the aforementioned linkage moved by the movement of the door 3. Consequently, the cartridge B is moved into its image formation position in the apparatus main assembly A, and is locked in the image formation position. Further, the driving force receiving section 63 of the cartridge B becomes engaged with the driving force output section of the apparatus main assembly A.

(4) Structure of Erroneous Cartridge Insertion Prevention Mechanism

Next, the structure of the erroneous cartridge insertion prevention mechanism is described. First, its operation is described with reference to a case (4-1) in which a cartridge B, which is compatible with the apparatus main assembly A, is inserted into the apparatus main assembly A. Then, a case (4-2) in which a cartridge B2, which is incompatible with the apparatus main assembly A is inserted into the apparatus main assembly A, and a case (4-3) in which the cartridge B which is incompatible with an apparatus main assembly A2, which is different from the apparatus main assembly A, is inserted into the apparatus main assembly A2, are described in the listed order.

A case where the cartridge B2 is inserted into the apparatus main assembly A2 is the same as the case where the cartridge B is inserted into the apparatus main assembly A, in terms of the operation of the erroneous cartridge insertion prevention mechanism. Therefore, it is not described here. In the following descriptions of these cases, the structural components of the apparatus main assembly A2 and the structural components of the cartridge B2, which are the same in function as the counterparts of the apparatus main assembly A and the cartridges B, are given the same referential codes as those given to the counterparts.

(4-1) Case in which Cartridge B which is Compatible with Main Assembly a is Inserted into Apparatus Main Assembly A First, referring to FIGS. 1, 3, and 6-16, the case in which the cartridge B (first cartridge) which is compatible with the apparatus main assembly A of the image forming apparatus 100 is inserted into the apparatus main assembly A is described.

Referring to FIGS. 6 and 8, the cleaning unit frame 71 of the cartridge B is provided with a pair of contacting sections, more specifically, the first and second contacting sections 73*a* and 73*b* (which hereafter are referred to as erroneous insertion prevention bosses 73*a* and 73*b*), which are on the outward surface of the left plate 71L, on the non-drive side.

It is not mandatory that both the drive side and non-drive sides of the cartridge B are provided with the erroneous insertion prevention bosses. That is, it may be only one of the two sides (driven side and non-driven side) of the cartridge B that is provided with the erroneous insertion prevention bosses 73. However, the description of the operation of the erroneous cartridge insertion prevention mechanism in this embodiment is given with reference to the case where the non-drive side of the cartridge B is provided with the erroneous insertion prevention bosses 73 (73*a* and 73*b*).

The apparatus main assembly A also has to be provided with structural components for preventing the insertion of an incompatible cartridge into the apparatus main assembly A. Further, the structural components have to be on the same side as the erroneous insertion prevention bosses 73*a* and 73*a*. Thus, the structural components of the erroneous cartridge insertion prevention mechanism of the apparatus main assembly A, which are on the non-drive side, are described.

Figure 11:
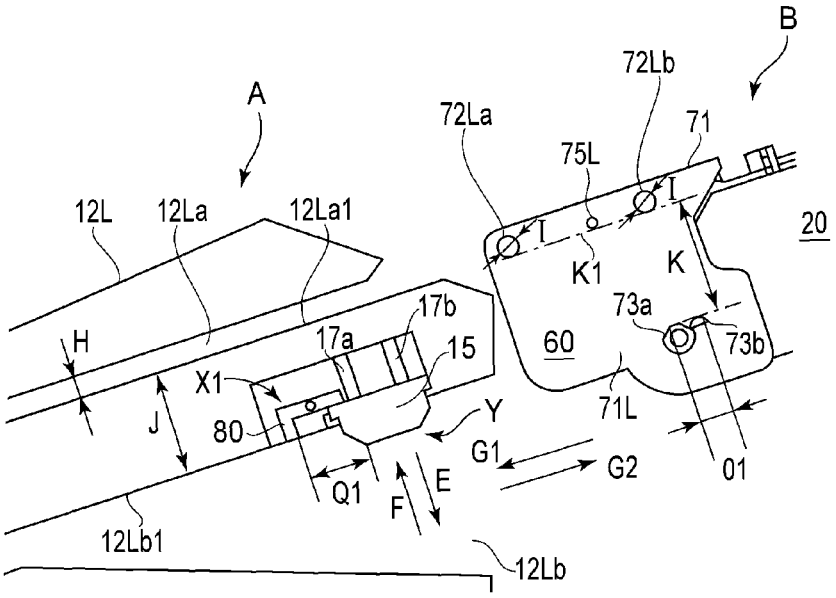
FIG. 11 is a drawing for describing the structure of the erroneous cartridge insertion preventing member of the apparatus main assembly, and that of a cartridge which is incompatible with the apparatus.

Referring to FIGS. 3, 7(*a*), and 9-11, the cartridge guiding left guide 12L of the apparatus main assembly A is provided with an erroneous insertion prevention groove 12Lb. Referring to FIG. 11, a letter J stands for the distance between the top surface 12Lb1 of the erroneous insertion prevention groove 12Lb, and the bottom surface 12La1 of the erroneous insertion prevention groove 12La. A letter K stands for the distance between a line K1 which is tangential to the bottom side (which faces erroneous insertion prevention bosses 73*a* and 73*b*) of the insertion-extraction guide bosses 72La and 72Lb, and the erroneous insertion prevention bosses 73*a* and 73*b*. The distance J is set to be less than the distance K.

Thus, when it is necessary to insert the cartridge B into the apparatus main assembly A, the cartridge B is to be inserted so that the insertion-extraction guide bosses 72La and 72Lb follow the cartridge guiding groove 12La to allow the erroneous insertion prevention bosses 73*a* and 73*b* to pass through the erroneous insertion prevention groove 12Lb.

In this embodiment, the apparatus main assembly A is structured so that the difference between the distance K between the aforementioned tangential line K1 and the erroneous insertion prevention bosses 73*a* and 73*b*, and the distance J between the top and bottom surfaces 12Lb1 and 12La1 is greater than the distance between the width H of the guiding groove 12La and the diameter I of the insertion-extraction guide boss 72La (K−J>H−I). Therefore, when the cartridge B is inserted into the apparatus main assembly A, the erroneous insertion prevention bosses 73*a* and 73*b* can be made to pass the erroneous insertion prevention groove 12Lb by simply making the insertion-extraction guide bosses 72La and 72Lb follow the guiding groove 12La as described above.

In other words, while the cartridge B is inserted into the apparatus main assembly A, the cartridge B is controlled in attitude because the insertion-extraction guide bosses 72La and 72Lb of the cartridge B are regulated by the cartridge guiding groove 12La as described above.

Referring to FIGS. 3 and 7(*a*), the apparatus main assembly A is provided with an erroneous insertion prevention member (first movable member) 15, which partially protrudes into the erroneous insertion prevention groove 12Lb of the cartridge guiding left member 12L. It is also provided with a rotational member (second movable member) 80, which is rotated by the movement of the erroneous insertion preventing member 15.

Figure 9:
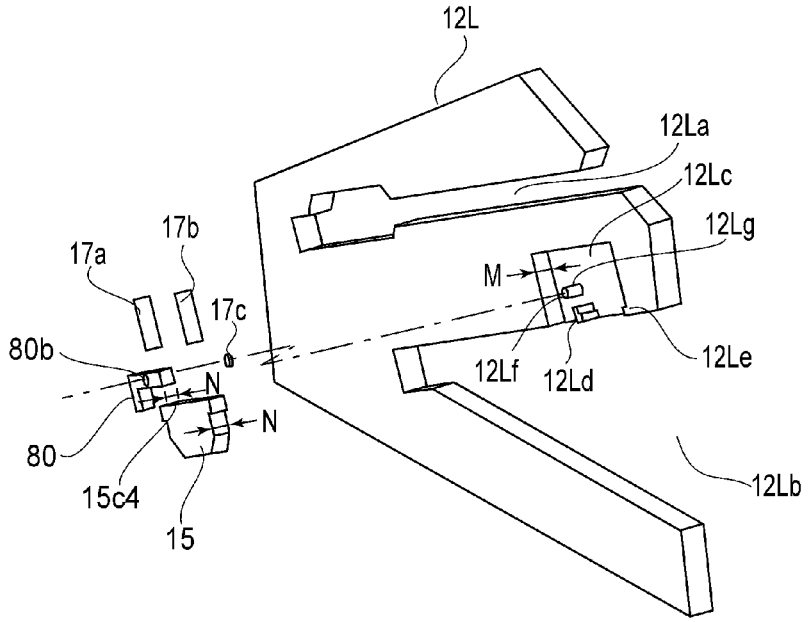
FIG. 9 is a perspective view of the erroneous cartridge insertion preventing member of the apparatus main assembly, and describes the structure of the member.
Figure 9:
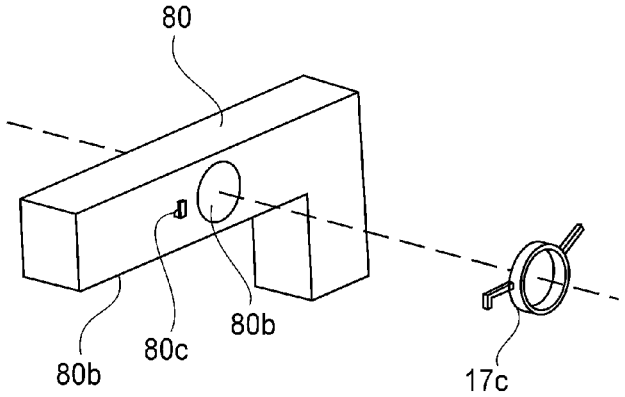

Next, referring to FIG. 9(*a*) which is an exploded perspective view of the cartridge guiding member 12L, the guiding member 12L is provided with a recess 12Lc, which is in the surface of the guiding member 12L, which is in contact with the lateral plate 16L of the apparatus main assembly A. The recess 12Lc is shaped so that its depth M is greater than the width N of the erroneous insertion prevention member 15 (dimension in terms of lengthwise direction (left/right direction of apparatus)). Next, referring to FIG. 10, the erroneous insertion preventing member 15 is held in the recess 12Lc of the guiding member 12L, and is kept under the pressure from a pair of compression springs 17*a* and 17*b*, which keep the erroneous insertion preventing member 15 pressed in the direction indicated by an arrow mark E. Thus, the erroneous insertion prevention member 15 is allowed to retreat in the direction indicated by an arrow mark F.

The distance by which the erroneous insertion preventing member 15 is allowed to protrude from the guiding member 12L is controlled by the contact between the protrusions 15*a* and 15*b*, with which the erroneous insertion preventing member 15 is provided, and the protrusions 12Ld and 12Le, with which the guiding member 12L is provided. Thus, the erroneous insertion preventing member 15 is held in its protruding position Y, in which it partially protrudes into the erroneous insertion prevention groove 12Lb of the guiding member 12L.

On the other hand, referring to FIGS. 9 and 11, the rotational member 80 is provided with a hole 80*b*, and a protrusion 80*c* for regulating the amount by which the rotational member 80 is rotationally moved. The protrusion 80*c* is on the surface of the rotational member 80, which faces the guiding member 12L. Further, the guiding member 12L is provided with a rotational member supporting boss 12Lf and a protrusion 12Lg, which are in the recess 12Lc of the guiding member 12L. Further, there is disposed a torsional coil spring 17*c* between the rotational member 80 and guiding member 12L.

The rotational member 80 is rotatably attached to the guiding member 12L in such a manner that the rotational member supporting boss 12Lf is fitted in the hole 80*b* of the rotational member 80, with the torsional coil spring 17*c* attached to the rotation amount regulating protrusion 80*c* and the rotation amount regulating protrusion 12Lg.

Figure 10:
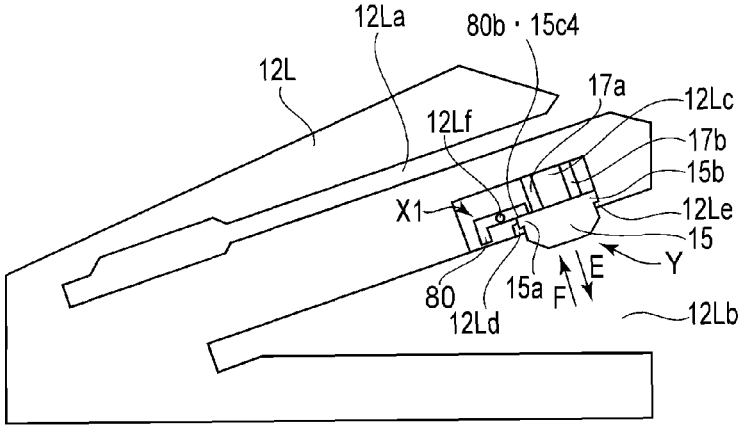
FIG. 10 is a sectional view of the erroneous cartridge insertion preventing member of the apparatus main assembly, and describes the structure of the member.

Therefore, the rotational member 80 is kept rotationally pressed by the torsional coil spring 17*c* so that it rotates in the clockwise direction in FIG. 10 about the rotational member supporting boss 12Lf. Thus, when the erroneous insertion preventing member 15 is in the above described protruding position Y, the surface 80*a* of the rotational member 80 is in contact with the surface 15*c*4 of the erroneous insertion preventing member 15. Therefore, the rotational member 80 remains held in its non-blocking position X1, in which it does not protrude from the recess 12Lc of the guiding member 12L.

As described above, as the cartridge B is inserted into the apparatus main assembly A, the insertion-extraction guide bosses 72La and 72Lb of the cartridge B pass through the cartridge guiding groove 12La, and the erroneous insertion prevention bosses 73*a* and 73 pass through the erroneous insertion prevention groove 12Lb. That is, the cartridge B can be inserted all the way into the apparatus main assembly A by moving the cartridge B in the cartridge insertion direction G1, along the cartridge guiding member 12L, as shown in FIG. 11.

Figure 1:
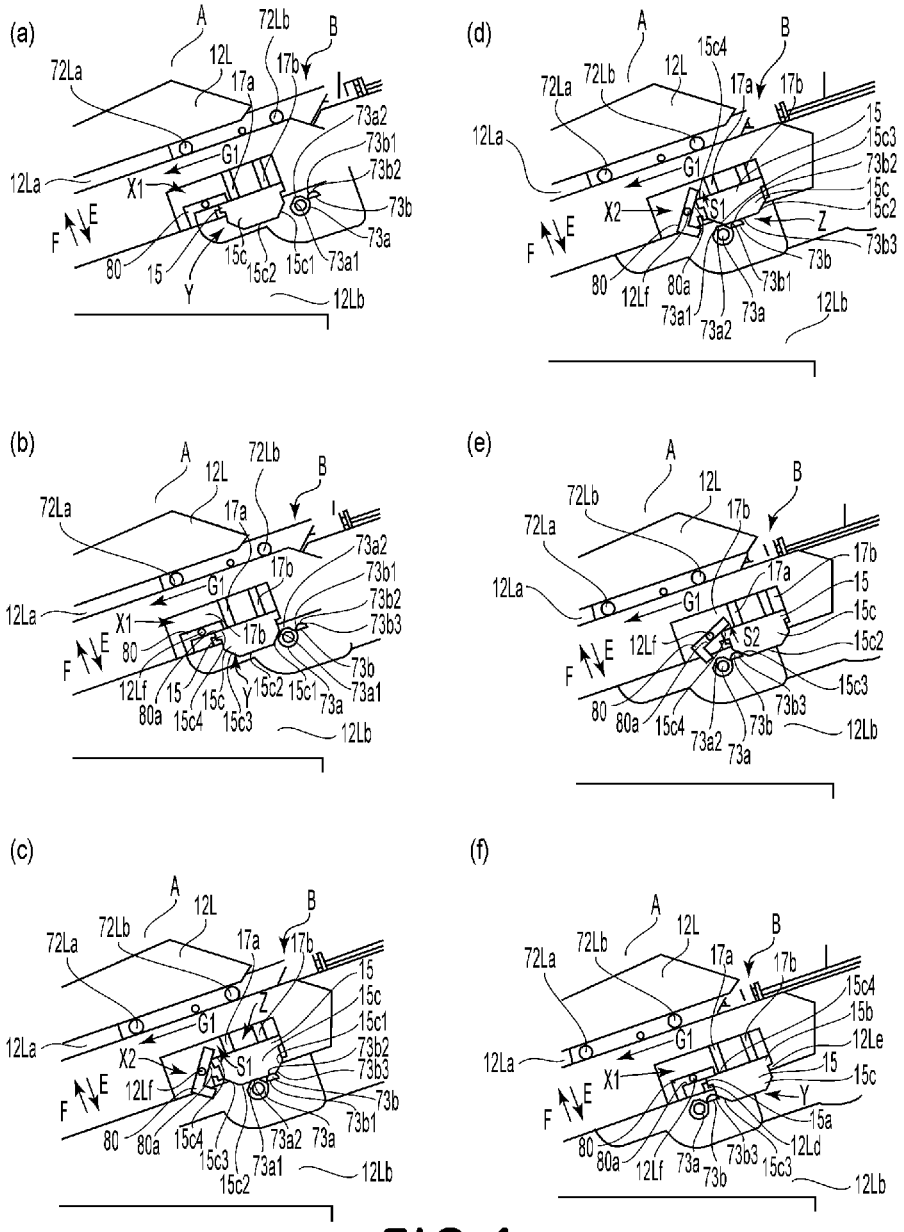
FIG. 1 is a drawing for describing the structural components, and their operations, of the image forming apparatus, in the first embodiment of the present invention, for preventing an incompatible cartridge from being inserted into the apparatus main assembly.
Figure 12:
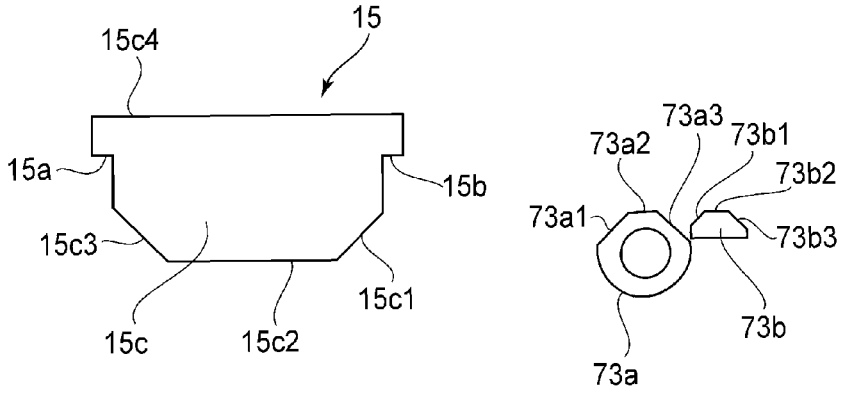
FIG. 12 is an enlarged view of a combination of the erroneous cartridge insertion preventing member of the apparatus main assembly, and the erroneous cartridge insertion prevention bosses of the incompatible cartridge.

Next, referring to FIGS. 1(*a*)-1(*f*), and 12, the action of the erroneous cartridge insertion preventing means, which occurs as the cartridge B is inserted into the apparatus main assembly A, is described in detail. FIG. 12 is auxiliary to FIG. 1, and is an enlarged view of the erroneous insertion prevention bosses 73*a* and 73*b* of the cartridge B, and the erroneous insertion preventing member 15 of the apparatus main assembly A. Hereafter, the action of the erroneous cartridge insertion preventing means is described in the order of FIGS. 1(*a*)-1(*f*).

(a): The cartridge B is moved in the cartridge insertion direction G1 shown in FIG. 1(*a*), so that the insertion-extraction guide bosses 72La and 72Lb fit into the guiding groove 12La, and follow the groove 12La. During this process, the erroneous insertion preventing member 15 is free from the regulatory components, and is in its protruding position Y, partially protruding from the recess 12Lc (guiding member 12L). Therefore, the rotational member 80 is held in the non-blocking position X1, in which it does not protrudes from the recess 12Lc of the guiding member 12L.

(b): As the cartridge B is moved further into the apparatus main assembly A, the erroneous insertion prevention boss 73*a* comes into contact with the contacted portion 15*c* (which hereafter may be referred to simply as protrusive portion 15*c*) of the erroneous insertion preventing member 15, which is in the protruding position Y. During this process, the surface 80*a* of the rotational member 80 is not being pressed by the surface 15*c*4 of the erroneous insertion preventing member 15. Therefore, the rotational member 80 remains held in the non-blocking position X1. As the surface 73*a*1 of the erroneous insertion prevention boss 73*a* comes into contact with the slanted surface 15*c*1 of the protrusive portion 15*c* of the erroneous insertion preventing member 15, the erroneous insertion prevention boss 73*a* causes the erroneous insertion preventing member 15 to retract in the direction indicated by the arrow mark F.

(c): The erroneous insertion preventing member 15 retracts to the retraction position Z in which the surface 15*c*2 of its protrusive portion 15*c* comes into contact with the surface 73*a*2 of the erroneous insertion prevention boss 73*a*. Thus, it becomes possible for the cartridge B to move further in the direction indicated by the arrow mark G1. Then, as the cartridge B is further moved, the surface 73*b*2 of the erroneous insertion prevention boss 73*b* comes into contact with the surface 15*c*2 of the protrusive portion 15*c* of the erroneous insertion preventing member 15. Thus, the erroneous insertion preventing member 15 is kept in the retraction position Z.

(d): As the protrusive portion 15*c* of the erroneous insertion preventing member 15 is made to retract from the paths of the erroneous insertion prevention bosses 73*a* and 73*b* of the cartridge B, in the direction indicated by the arrow mark F, the erroneous insertion prevention bosses 73*a* and 73*b* are allowed to move past the surface 15*c*2 of the protrusive portion 15*c* of the erroneous insertion preventing member 15.

As for the surface 80*a* of the rotational member 80, it is remaining in contact with the surface 15*c*4 of the erroneous insertion preventing member 15. Therefore, it is pressed by the force S1 in the direction indicated by the arrow mark F, as shown in FIGS. 1(*c*) and 1(*d*), because the erroneous insertion preventing member 15 was made to retract in the direction indicated by the arrow mark F as described above.

Therefore, the rotational member 80 rotates counterclockwise about the rotational member support boss 12Lf, from the non-blocking position X1 to the blocking position X2, in which the rotational member 80 partially protrudes in the direction indicated by the arrow mark E in FIG. 1(*d*), from the recess 12Lc of the guiding member 12L, and therefore, it can come into contact with the erroneous insertion prevention boss 73*a*.

(e): As the cartridge B is moved further into the apparatus main assembly A, the surface 73*a*2 of the erroneous insertion prevention boss 73*a* disengages from the surface 15*c*2 of the erroneous insertion preventing member 15, and the surface 73*b*3 of the erroneous insertion prevention boss 73*b* comes into contact with the slanted surface 15*c*3 of the erroneous insertion preventing member 15. Thus, the erroneous insertion preventing member 15 moves from its non-protruding position Z toward the protruding position Y in the direction indicated by the arrow mark E, with the surface 15*c*3 of the erroneous insertion preventing member 15 sliding on the surface 73*b*3 of the erroneous insertion prevention boss 73*b*.

Meanwhile, as the erroneous insertion preventing member 15 begins to be moved in the direction indicated by the arrow mark E in FIG. 1(*e*), the amount of the pressure S2 which the surface 80*a* of the rotational member 80 receives from the surface 15*c*4 of the erroneous insertion preventing member 15 becomes smaller than the aforementioned amount of the pressure S1, because as the erroneous insertion preventing member 15 moves in the direction indicated by the arrow mark E from its non-protruding position Z to its protruding position Y, the compression springs 17*a* and 17*b* reduce in the amount of the pressure they apply to the erroneous insertion preventing member 15, reducing thereby the amount of the pressure which the surface 80*a* of the rotational member 80 receives from the surface 15*c*4 of the erroneous insertion preventing member 15. As a result, the rotational member 80 begins to rotates clockwise about the rotational member supporting boss 121*f* from its blocking position X2.

(f): Then, as the cartridge B is moved further into the apparatus main assembly A, the projection 15*a* and 15*b* of the erroneous insertion preventing member 15, which are for regulating the amount by which the erroneous insertion preventing member 15 is allowed to protrude from the recess 12Lc, come into contact with the protrusions 12Ld and 12Le of the guiding member 12L, which are for regulating the amount by which the erroneous insertion preventing member 15 is allowed to protrude from the recess 12Lc. Thus, the erroneous insertion preventing member 15 is kept in its protruding position Y.

As the cartridge B is further moved inward of the apparatus main assembly A, the surface 73*b*3 of the erroneous insertion prevention boss 73*b* disengages from the surface 15*c*3 of the erroneous insertion preventing member 15, and therefore, the surface 80*a* of the rotational member 80 stops receiving pressure from the surface 15*c*4 of the erroneous insertion preventing member 15. Thus, the rotational member 80 is held in the non-blocking position X1 as described above, allowing thereby the erroneous insertion prevention bosses 73*a* and 73*b* to pass by the rotational member 18, on the side indicated by the arrow mark E.

Because the erroneous insertion prevention bosses 73*a* and 73*b* of the cartridge B are allowed to pass by the protrusive portion 15*c* of the erroneous insertion preventing member 15, and the rotational member 80, on the side indicated by the arrow mark E, as described above, it becomes possible for the cartridge B to be inserted into its image formation position in the apparatus main assembly A.

The action of the structural components of the image forming apparatus (inclusive of cartridge B) which occurs when the cartridge B is extracted from the apparatus main assembly A is the reversal of the above described action of the structural components, which occurs when the cartridge B is inserted into the apparatus main assembly A. That is, as the cartridge B in the cartridge chamber 101 is pulled outward in the cartridge extraction direction G2, the means for preventing the insertion of an incompatible cartridge from being carried out in reversal sequence the steps shown in FIGS. 1(*f*)→1(*e*)→1(*d*)→1(*c*)→1(*b*)→1(*a*), allowing thereby the cartridge B to be extracted from the apparatus main assembly A.

Figure 13:
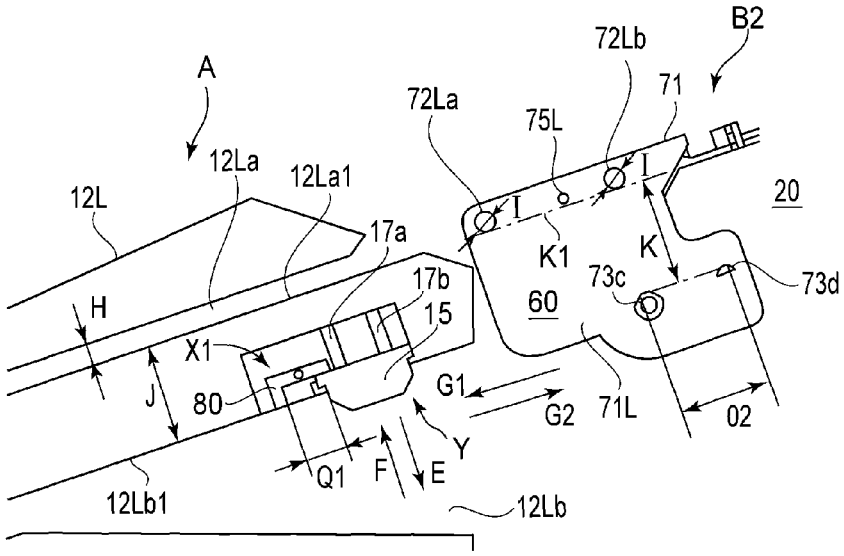
FIG. 13 is a drawing for describing the structure of the erroneous cartridge insertion preventing member of the apparatus main assembly, and that of the incompatible cartridge.
Figure 14:
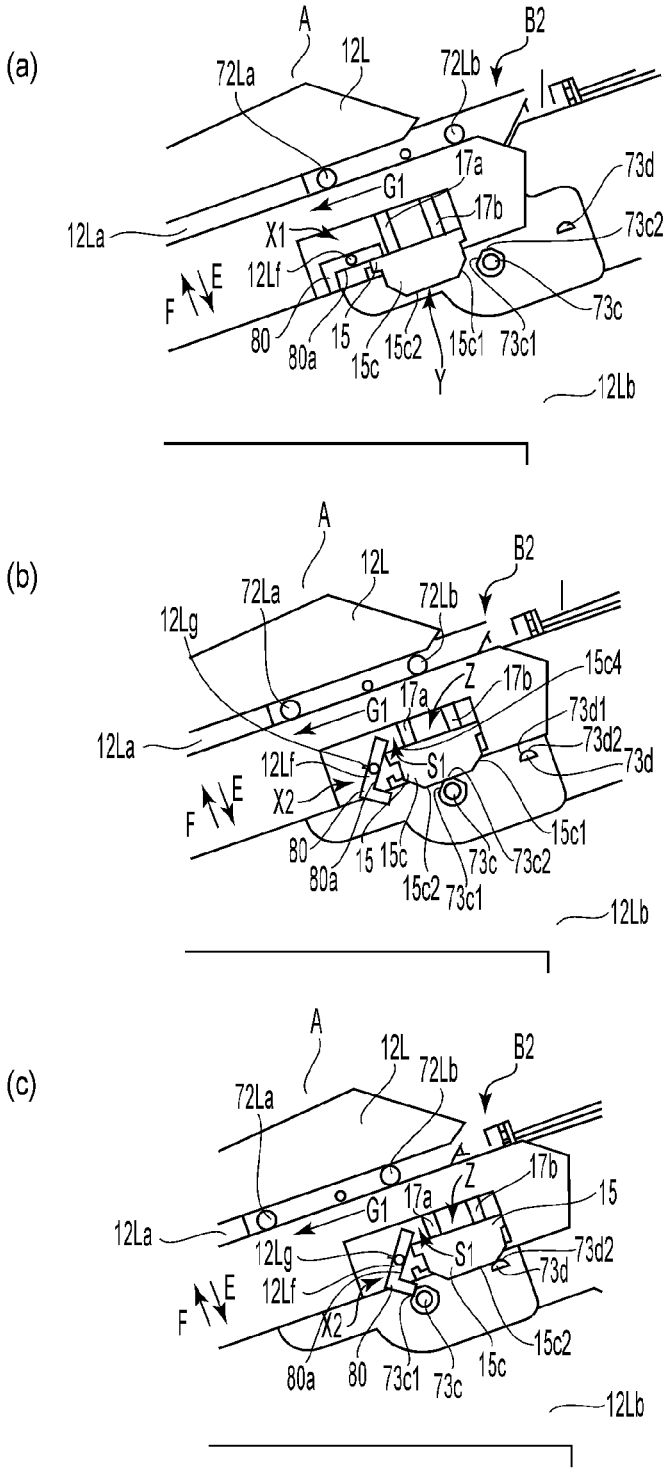
FIG. 14 is a drawing for describing the operation of the erroneous cartridge insertion preventing member of the apparatus main assembly, and that of the erroneous cartridge insertion preventing member of the incompatible cartridge, which occurs as the incompatible cartridge is inserted into the apparatus main assembly.

(4-2) Case in which Incompatible Cartridge B2 is Inserted into Apparatus Main Assembly A Next, referring to FIGS. 13 and 14, a case in which a cartridge B2 (second cartridge), which is incompatible with the first image forming apparatus 100, is inserted into the apparatus main assembly A of the image forming apparatus 100 is described. FIG. 13 is a drawing for describing the erroneous insertion prevention boss of the cartridge B2. FIG. 14 is a drawing for describing the movements, which occur to the structural components of the erroneous cartridge insertion preventing means if the cartridge B2 is inserted into the apparatus main assembly A.

Referring to FIG. 13, the non-drive end (left end plate 71L) of the cleaning unit frame 71 of the cartridge B2 is provided with erroneous insertion prevention bosses 73*c* and 73*d*, like the erroneous insertion prevention bosses 73*a* and 73*b* of the cartridge B (FIG. 11). However, the distance O2 between the erroneous insertion prevention bosses 73*c* and 73*d* in terms of the cartridge insertion direction indicated by the arrow mark G1 in FIG. 13 is set greater than the distance O1 between the erroneous insertion prevention bosses 73*a* and 73*b* of the cartridge B shown in FIG. 11.

Referring to FIGS. 14(*a*)-(*c*), the operation, which is carried out by the means for preventing the insertion of an incompatible cartridge, as the cartridge B2 is inserted into the apparatus main assembly A, is described in detail.

(a): The cartridge B2 is inserted into the apparatus main assembly A in the direction indicated by an arrow mark G1, in such a manner that the insertion-extraction guide bosses 72La and 72Lb of the cartridge B2 follow the guiding groove 12La of the guiding member 12L. During this process, the erroneous insertion preventing member 15 is free from the regulatory components, and is in its protruding position Y. Therefore, the rotational member 80 is in its non-blocking position X1, remaining entirely in the recess 12Lc.

Therefore, the erroneous insertion prevention boss 73*c* comes into contact with the protrusive portion 15*c* of the erroneous insertion preventing member 15, like the protrusive portion 15*c* of the erroneous insertion preventing member 15 of the cartridge B. Thus, the surface 73*c*1 of the erroneous insertion prevention boss 73*c* comes into contact with the surface 15*c*1 of the protrusive portion 15*c* of the erroneous insertion preventing member 15, causing the erroneous insertion preventing member 15 to retreat in the direction indicated by an arrow mark F.

(b): Thus, the contact between the surface 73*c*2 of the erroneous insertion prevention boss 73*c* and the surface 15*c*2 of the protrusive portion 15*c* of the erroneous insertion preventing member 15 keeps the erroneous insertion preventing member 15 in the non-protruding position Z, allowing thereby the cartridge B to move further in the direction indicated by the arrow mark G1.

As for the rotational member 80, its surface 80*a* is in contact with the surface 15*c*4 of the erroneous insertion preventing member 15. Thus, as the erroneous insertion preventing member 15 is made to retreat in the direction indicated by the arrow mark F, the surface 80*a* is subjected to an amount S1 of pressure by the surface 15*c*4. Thus, the rotational member 80 rotationally moves counterclockwise about the rotational member supporting boss 12Lf, from the non-blocking position X1 into the blocking position X2, while gradually protruding from the recess 12Lc of the guiding member 12L, being enabled to contact the erroneous insertion prevention boss 73*a*.

(c): As the cartridge B2 is moved further, the surface 73*c*1 of the erroneous insertion prevention boss 73*c* comes into contact with the rotational member 80 for the following reason. That is, at this point, the erroneous insertion prevention boss 73*d* is in contact with the surface 15*c*2 of the protrusive portion 15*c* of the erroneous insertion preventing member 15, and therefore, the erroneous insertion preventing member 15 is in the non-protruding position Z. Therefore, the rotational member 80 is kept in the blocking position X2.

Therefore, it is impossible for the cartridge B2 to be moved further in the direction indicated by the arrow mark G1. That is, it is impossible for the cartridge B2 to be inserted into the image formation position in the apparatus main assembly A.

As for the extraction of the cartridge B2 from the apparatus main assembly A when the cartridge B2 is in the above described position, it is possible because as the cartridge B2 is pulled outward, the surface 73*c*2 of the erroneous insertion prevention boss 73*c* comes into contact with the surface 15*c*1 of the protrusive portion 15*c* of the erroneous insertion preventing member 15, and keeps the erroneous insertion preventing member 15 in the non-protruding position Z (FIG. 14(*b*)). As soon as the cartridge B2 is extracted, the erroneous insertion preventing member 15 becomes free from the regulatory components, and therefore, returns to its protruding position Y, and the rotational member 80 returns to its non-blocking position X1 (FIG. 14(*a*)).

Figure 15:
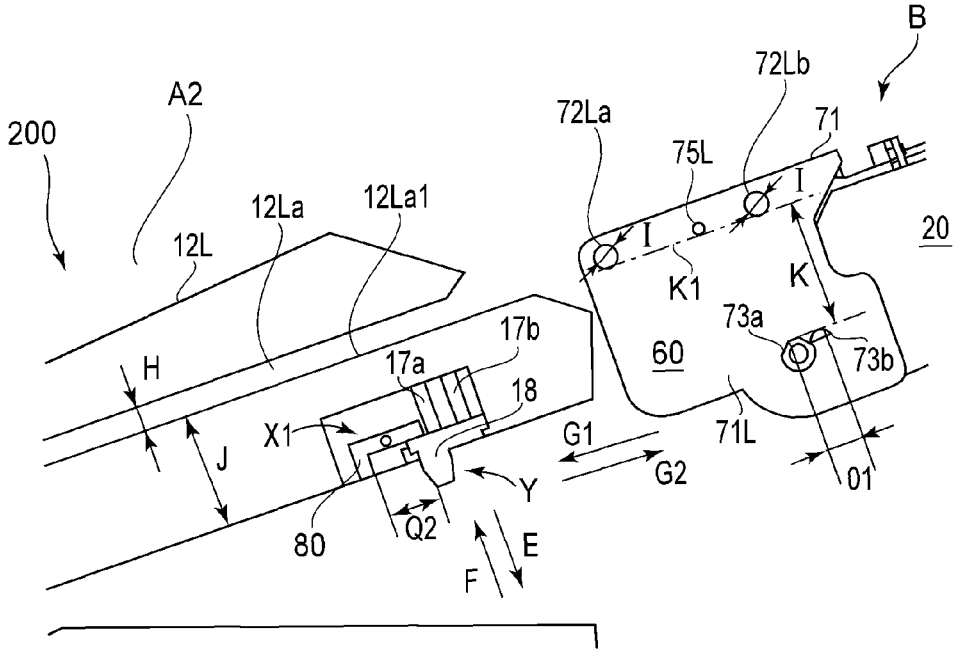
FIG. 15 is a drawing for describing the erroneous cartridge insertion preventing member for the apparatus main assembly, which is different from the one for the image forming apparatus in the first embodiment.
Figure 16:
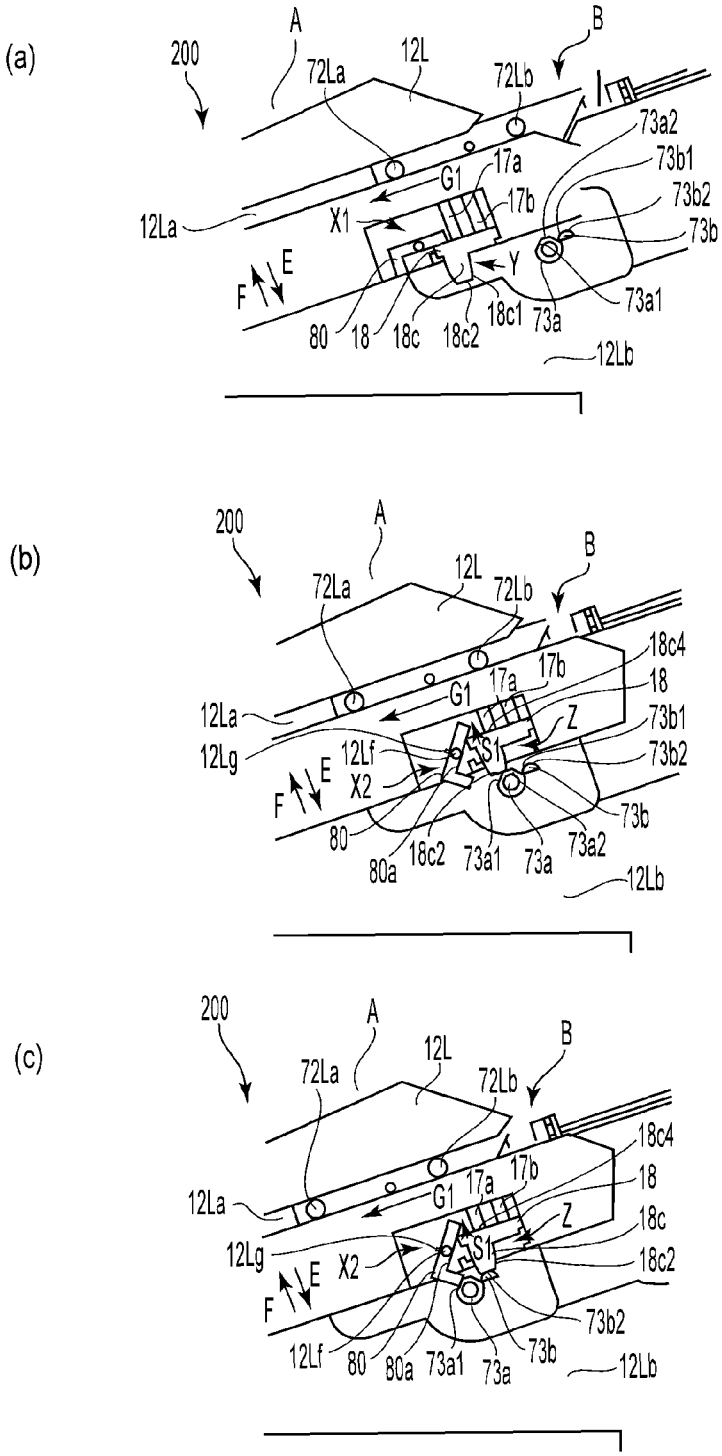
FIG. 16 is a drawing for describing the operation of the erroneous cartridge insertion preventing member of the apparatus main assembly which is different from that in the first embodiment, and the operation of the erroneous cartridge insertion preventing member of the cartridge in the first embodiment, which occurs as the cartridge is inserted into the apparatus main assembly.

(4-3) Case in which Cartridge B is Inserted into Apparatus Main Assembly A2 which is Incompatible with Cartridge B Described next referring to FIGS. 15 and 16 is a case in which the cartridge B is inserted into the main assembly A2 of the second image forming apparatus 200, which is different from the first image forming apparatus 100, in terms of the structural arrangement for preventing the insertion of an incompatible cartridge into the apparatus main assembly A. FIG. 15 is a drawing for describing the structure of the apparatus main assembly A2, which is different from the apparatus main assembly A, in terms of their structural arrangement for preventing the problem that a cartridge which is incompatible with a given image forming apparatus is inserted into the apparatus. FIG. 16 is a drawing for describing the operation of the structural arrangement of the apparatus main assembly A2, which is for preventing the cartridge B from being inserted into the image formation position in the apparatus main assembly A2.

Referring to FIG. 15, the non-drive side of the apparatus main assembly A2 is provided with an erroneous insertion preventing member 18 (third movable member), as the non-drive side of the apparatus main assembly A is provided with the erroneous insertion preventing member 15. However, in terms of the direction, indicated by an arrow mark G1, in which the cartridge B is to be inserted into the apparatus main assembly A2, the distance Q2 between the erroneous insertion preventing member 18 and rotational member (fourth movable member) 80 is set to be less than the distance Q1 between the erroneous insertion preventing member 15 and rotational member 80 of the apparatus main assembly A, for the following reason.

That is, this setup is for making it possible for the cartridge B2, which is compatible with the apparatus main assembly A2, to be inserted into its image formation position in the apparatus main assembly A2, like the cartridge B is installable in its image formation position in the apparatus main assembly A. That is, this setup is for positioning the erroneous insertion preventing member 18 and rotational member 80 so that the cartridge B2 can be inserted into its image formation position in the apparatus main assembly A2. More specifically, it is for ensuring that after the erroneous insertion prevention boss 73*c* moves past the erroneous insertion preventing member 18, on the side indicated by the arrow mark E, the erroneous insertion prevention boss 73*d* does not come into contact with the erroneous insertion preventing member 18, and the erroneous insertion prevention boss 73*c* does not come into contact with the rotational member 80.

Referring to FIGS. 16(*a*)-16(*c*), the action which takes place in the apparatus main assembly A2 as the cartridge B is inserted into the apparatus main assembly A2 is described in detail.

(a): A user is to move the cartridge B in the cartridge insertion direction indicated by an arrow mark G1 while causing the insertion-extraction guide bosses 72La and 72Lb to follow the guiding groove 12La of the guiding member 12L. During this movement of the cartridge B, the erroneous insertion preventing member 18 is free from the regulatory components, and is in the protruding position Y. Therefore, the rotational member 80 is kept in the non-blocking position X1 where the rotational member 80 does not protrude from the recess 12Lc of the guiding member 12.

(b): Thus, the erroneous insertion prevention boss 73*a* comes into contact with the protrusive portion 18*c* of the erroneous insertion preventing member 18, like when the cartridge B is inserted into the apparatus main assembly A. Thus, the erroneous insertion preventing member 18 is made to retreat in the direction indicated by the arrow mark F by the erroneous insertion prevention boss 73*a*, more specifically, the contact between the surface 73*a*1 of the erroneous insertion prevention boss 73*a* and the surface 18*c*1 of the protrusive portion 18*c* of the erroneous insertion preventing member 18.

Thus, the erroneous insertion preventing member 18 is moved into its non-protruding position Z by the contact between the surface 73*a*2 of the erroneous insertion prevention boss 73*a* and the surface 18*c*2 of the protrusive portion 18*c* of the erroneous insertion preventing member 18, making it possible for the cartridge B to move further in the direction indicated by the arrow mark G1.

Meanwhile, the surface 80*a* of the rotational member 80 is in contact with the surface 18*c*4 of the erroneous insertion preventing member 18. Thus, as the erroneous insertion preventing member 18 is made to retreat in the direction indicated by the arrow mark F, the surface 80*a* of the rotational member 80 is subjected to the pressure S1 which acts in the direction indicated by the arrow mark F. Therefore, the rotational member 80 is rotationally moved counterclockwise about the rotational member supporting boss 12Lf, from the non-blocking position X1, while being made to gradually protrude from the recess 12Lc of the guiding member 12L, to the blocking position X2, in which it partially protrudes from the recess 12Lc of the guiding member 12L, ensuring that the erroneous insertion prevention boss 73*a* comes into contact with the rotational member 80.

(c): As the cartridge B is moved further inward of the apparatus main assembly A2, the surface 73*a*1 of the erroneous insertion prevention boss 73*a* comes into contact with the rotational member 80 for the following reason. That is, the erroneous insertion prevention boss 73*b* is in contact with the surface 18*c*2 of the protrusive portion 18*c* of the erroneous insertion preventing member 18. Therefore, the erroneous insertion preventing member 18 remains in the non-protrusive position. Therefore, the rotational member 80 is kept in the blocking position.

Therefore, it is impossible for the cartridge B to be moved further in the direction indicated by the arrow mark G1. In other words, it is impossible for the cartridge B to be inserted into the image formation position in the apparatus main assembly A2.

The cartridge B which is in the position shown in FIG. 16(*c*) can be easily extracted from the apparatus main assembly A2, because as the cartridge B is pulled in the cartridge extraction direction (indicated by arrow mark G2), the surface 73*a*2 of the erroneous insertion prevention boss 73*c* comes into contact with the surface 18*c*2 of the protrusive portion 18*c* of the erroneous insertion preventing member 18, and making it possible for the erroneous insertion preventing member 18 to move to the non-protruding position Z (FIG. 16(*b*)). Thus, the erroneous insertion preventing member 18 is freed from the regulatory components, and therefore, it returns to the protruding position Y, and so does the rotational member 80 return to the non-blocking position X1 (FIG. 16(*a*)).

(5) Summary

The structure of the image forming apparatus 100 in the first embodiment of the present invention can be summarized as follows.

1) The image forming apparatus 100 is an apparatus for forming an image on a sheet P of recording medium. It employs the cartridge B which has the first and second portions 73*a* and 73*b* for contact, and is removably installable in the apparatus main assembly A. It has the portion 15*c* with which the cartridge B comes into contact, and the movable member 15 which is movable between its protrusive and non-protrusive positions Y and Z. It has also the rotational member 80, which is rotationally movable in such a manner that when the abovementioned movable member 15 is in the protruding position Y, it is in its non-blocking position X1, whereas as the movable member 15 moves to the non-protruding position Z, the rotational member 18 is moved into the blocking position X2 by the movable member 15.

As the cartridge B is inserted into the apparatus main assembly A, the second portion 73*b* for contact disengages from the portion 15*c* of contact of the movable member 15 after the first portion 73*a* of contact passes by the movable member 15, on the side indicated by the arrow mark E in which the movable member 15 protrudes. Therefore, it is possible for the first portion 73*a* of contact to pass by the rotational member 80, on the side to which the rotational member 80 was protruding.

2) As the cartridge B is inserted into the apparatus main assembly A, the first portion 73*a* of contact passes by the movable member 15, on the side of the portion 15*c* of contact. Thereafter, the second portion 73*b* of contact makes the movable member 15 retreat into the non-protrusive position Z. At this point in time, there is no contact between the first portion 73*a* of contact and rotational member 80.

3) The movable member 15 has a flat surface 15*c*3 which is tilted in such an attitude that its upstream side in terms of the direction G1 in which the cartridge B is inserted into the apparatus main assembly A, is on the downstream side in terms of the direction, indicated by the arrow mark F, in which the movable member 15 is made to retreat.

4) The movable member 15 has the flat surface 15*c*1 which is tilted in such an attitude that its upstream side in terms of the direction, indicated by the arrow mark G1, in which the cartridge B is inserted into the apparatus main assembly A, is on the upstream side in terms of the direction, indicated by the arrow mark E, in which the movable member 15 protrudes.

5) The movable member 15 is disposed on the upstream side of the rotational member 80 in terms of the direction, indicated by the arrow mark G1, in which the cartridge B is inserted into the apparatus main assembly A.

6) The movable member 15 is under the pressure generated by the pressure applying means 17*a* and 17*b* so that when it is free from the regulatory components other than the pressure applying means 17*a* and 17*b*, it is in the protruding position Y.

7) The movable member 15 is held by the guiding member 12L which guides the cartridge B when the cartridge B is inserted into the apparatus main assembly A. Further, the cartridge B is provided with insertion-extraction guide bosses 72La and 72Lb, which are guided by the guiding member 12L while the cartridge B is inserted into the apparatus main assembly A.

The structure of the cartridge B is as follows:

1) The cartridge B is such a cartridge which is removably installable in the main assembly A of the image forming apparatus 100 which forms an image on a sheet P of recording medium. The apparatus main assembly A has the movable member 15, which has the portion 15*c* with which the cartridge B comes into contact while the cartridge B is inserted into the apparatus main assembly A. The movable member 15 is movable between the protruding position Y and non-protruding position Z. Further, the apparatus main assembly A has also the rotational member 80, which is rotationally movable between the non-blocking position X1 in which it is when the movable member 15 is in the protruding position Y, and the blocking position X2 in which it is when the movable member 15 is in the non-protruding position Z.

The cartridge B is provided with the first and second portions (73*a* and 73*b*) of contact. While the cartridge B is inserted into the apparatus main assembly A, it is after the first portion 73*a* of contact moves past the movable member 15, on the side toward which it protrudes as indicated by the arrow mark E, that the second portion 73*b* of contact becomes disengaged from the first portion 15*c* of contact. Therefore, it is possible for the first portion 73*a* to pass by the rotational member 80, on the side toward which the rotational member 80 protrudes.

2) While the cartridge B is inserted into the apparatus main assembly A, the first portion 73*a* of contact passes the movable member 15, on the side of the portion 15*c* of contact, and disengages from the portion 15*c* of contact. Thereafter, when the second portion 73*b* of contact causes the movable member 15 to retreat into the non-protrusive position, the first portion 73*a* of contact is not in contact with the rotational member 80.

The structure of the main assembly A is as follows:

1) The main assembly A of the image forming apparatus 100 which forms an image on a sheet P of recording medium is such an assembly in which the cartridge B having the first and second portions 73*a* and 73*b* of contact is removably installable. It has the movable member 15 and rotational member 80. The movable member 15 has the portion 15*c* with which the cartridge B comes into contact. The movable member 15 is movable between the protruding position Y and non-protruding position Z. When the movable member 15 is in the protruding position Y, the rotational member 80 is in the non-blocking position X1, whereas as the movable member 15 is made to retreat into the non-protruding position Z, the rotational member 80 is rotationally moved into the blocking position X2 by the movable member 15.

Also while the cartridge B is inserted into the apparatus main assembly A, the second portion 73*b* of contact becomes disengaged from the protrusive portion 15*c* of the movable member 15 after the first portion 73*a* passes the movable member 15, on the side toward which the movable member 15 protrudes. Therefore, the first portion 73*a* of contact is allowed to pass the rotational member 80, on the side toward which the rotational member 80 protrudes.

2) While the cartridge B is inserted into the apparatus main assembly A, the first portion 73*a* of contact passes the movable member 15, on the side toward which the protrusive portion 15*c* protrudes, and disengages from the portion 15*c* of contact. Thereafter, when the second portion 73*b* of contact causes the movable member 15 to retreat into the non-protrusive position, the first portion 73*a* of contact is not in contact with the rotational member 80.

3) The movable member 15 has the flat surface 15*c*3, which is tilted in such an attitude that the downstream side of the flat surface 15*c*3 in terms of the cartridge insertion direction indicated by the arrow mark G1 is on the upstream side in terms of the direction, indicated by the arrow mark F, in which the movable member 15 is made to retreat.

4) The movable member 15 has the flat surface 15*c*1, which is tilted in such an attitude that its upstream side in terms of the direction, indicated by the arrow mark G1, in which the cartridge B is inserted into the apparatus main assembly A, is on the downstream side in terms of the direction, indicated by the arrow mark E, in which the movable member 15 protrudes.

5) The movable member 15 is disposed on the upstream side of the rotational member 18 in terms of the direction, indicated by the arrow mark G1, in which the cartridge B is inserted into the apparatus main assembly A.

6) The movable member 15 is kept pressed toward the protruding position Y by the elastic pressing means 17*a* and 17*b*.

7) The movable member 15 is held by the guiding member 12L which is for guiding the insertion-extraction guide bosses 72La and 72Lb, with which the cartridge B is provided, while the cartridge B is inserted into the apparatus main assembly A.

The structure of the system for preventing the problem that a process cartridge is installed into an electrophotographic image forming apparatus which is not compatible with the process cartridge is as follows:

This system is for preventing the problem that a cartridge B, which is removably installable in the main assembly A of an image forming apparatus 100 for forming an image on a sheet P of recording medium, is erroneously installed into the main assembly of an image forming apparatus which is not compatible with the cartridge B. The apparatus main assembly A has the movable member 15 and rotational member 80. The movable member 15 has the portion 15*c* with which the process cartridge B comes into contact. It is movable between the protruding position Y and non-protruding position Z. The rotational member 80 is movable between its non-blocking position X1, in which it is when the movable member 15 is in the protruding position Y, and the blocking position X2, in which it is when the movable member 15 is in the non-protruding position Z. Further, the cartridge B is provided with the first and second portions 73*a* and 73*b* of contact.

While the cartridge B is inserted into the apparatus main assembly A, it is the first portion 73*a* of contact that passes first the movable member 15, on the side, indicated by the arrow mark E1, toward which the movable member 15 protrudes. Further, it is after the first portion 73*a* of contact passes the portion 15*c* of the movable member 15 that the second section 73*b* of contact becomes disengaged from the portion 15*c* of the movable member 15. Therefore, the first portion 73*a* of contact is allowed to pass the rotational member 80, on the side toward which the rotational member 80 protrudes.

The system, in this embodiment, for preventing the problem that a process cartridge is installed in the main assembly of an electrophotographic image forming apparatus which is not compatible with the process cartridge, is structured as described above. Therefore, the system can be positioned close to the cartridge entrance of the apparatus main assembly A. Further, the system is structured so that the erroneous insertion preventing member 15 is disposed in the recess 12Lc of the cartridge guiding member 12L, and is enabled to move in the direction indicated by the arrow mark E or F to allow the erroneous insertion prevention bosses 73*a* and 73*b* to pass the erroneous insertion preventing member 15, on the side indicated by the arrow mark E. Therefore, the employment of this system does not affect the apparatus main assembly A in dimension in terms of the lengthwise direction. Further, the system is simple in structure, and yet, can ensure that the above-described problem is prevented regardless of any combination between a process cartridge, and an image forming apparatus incompatible with the cartridge, vice versa.

Therefore, it is possible to provide a combination of an image forming apparatus and a process cartridge therefor, which is simple in structure, can make it possible to determine whether the cartridge which is being inserted into the apparatus main assembly A is compatible with the apparatus main assembly A, while the cartridge is in the adjacencies of the cartridge entrance of the apparatus main assembly A, and yet, can reliably prevent the installation of a cartridge into an image forming apparatus incompatible with the cartridge. Further, the employment of this system does not affect an image forming apparatus in length.

Embodiment 2

The image forming apparatus in the first embodiment can be modified in structure so that in order to prevent the problem that a cartridge is inserted all the way into the main assembly of an image forming apparatus, the apparatus main assembly A is provided with the first and second portions 73*a* (73*e*) and 73*b* (73*f*) of contact, and the cartridge B is provided with the movable member 15 (18) and rotational member 80.

That is, the structure of the image forming apparatus 100 in this embodiment is as follows:

1) The image forming apparatus 100 in this embodiment is an apparatus for forming an image on a sheet P of recording medium, and employs a cartridge B which is removably installable in the apparatus main assembly A. The cartridge B is provided with a movable member 15 and a rotational member 80. The movable member 15 has a portion 15*c* which comes into contact with the counterpart of the apparatus main assembly. It is movable between the protruding position Y and non-protruding position Z. The rotational member 80 is rotationally movable between the non-blocking position X1, in which it is when the movable member 15 is in the protruding position Y, and the blocking position X2, in which it is when the movable member 15 is in the non-protruding position Z. The apparatus main assembly A has the first and second portions 73*a* and 73*b* of contact.

As the cartridge B is inserted into the apparatus main assembly A, the cartridge contacting first portion 73*a* passes by the movable member 15, on the side, indicated by the arrow mark E, toward which the movable member 15 protrudes. The cartridge catching section 73*b* becomes disengaged from the protrusive portion 15*c* of the movable member 15. Therefore, the first portion 73*a* is allowed to pass the rotational member 80, on the side toward which the rotational member 80 protrudes.

2) While the cartridge B is inserted into the apparatus main assembly A, the first portion 73*a* of contact passes by the movable member 15, on the side of the protrusive portion 15*c*, and disengages from the protrusive portion 15*c*. It is before the first portion 73*a* of contact disengages from the protrusive portion 15*c* that the second portion 73*b* comes into contact with the protrusive portion 15*c* and causes the movable member 15 into the non-protrusive position Z. Therefore, the first portion 73*a* of contact is not in contact with the rotational member 80.

3) The movable member 15 has a flat surface 15*c*3 which is tilted in such an attitude that its downstream side in terms of the direction G1 in which the cartridge B is inserted into the apparatus main assembly A, is on the upstream side in terms of the direction, indicated by the arrow mark F, in which the movable member 15 is made to retreat.

4) The movable member 15 has the flat surface 15*c*1 which is tilted in such an attitude that its upstream side in terms of the direction, indicated by the arrow mark G1, in which the cartridge B is inserted into the apparatus main assembly A, is on the downstream side in terms of the direction, indicated by the arrow mark E, in which the movable member 15 protrudes.

5) The movable member 15 is disposed on the upstream side of the rotational member 80 in terms of the direction, indicated by the arrow mark G1, in which the cartridge B is inserted into the apparatus main assembly A.

6) The movable member 15 is under the pressure generated by the pressure applying means 17*a* and 17*b* so that when it is free from the regulatory components other than the pressure applying means 17*a* and 17*b*, it is in the protruding position Y.

7) Further, the cartridge B is provided with insertion-extraction guide bosses 72La and 72Lb, which are guided by the guiding member 12L while the cartridge B is inserted into the apparatus main assembly A.

The structure of the cartridge B is as follows:

1) The cartridge B is such a cartridge which is removably installable in the main assembly A of the image forming apparatus 100 which forms an image on a sheet P of recording medium. It is provided with the first and second portions 73*a* and 73*b* of contact. It has a movable member 15 and a rotational member 80. The movable member 15 has the portion 15*c* with which the cartridge B comes into contact with the counterpart of the apparatus main assembly while the cartridge B is inserted into the apparatus main assembly A. The movable member 15 is movable between the protruding position Y and non-protruding position Z. The rotational member 80 is rotationally movable between the non-blocking position X1 in which it is when the movable member 15 is in the protruding position Y, and the blocking position X2 in which it is when the movable member 15 is in the non-protruding position Z.

While the cartridge B is inserted into the apparatus main assembly A, it is after the first portion 73*a* of contact moves past the movable member 15, on the side toward which it protrudes as indicated by the arrow mark E, that the second portion 73*b* of contact becomes disengaged from the first portion 15*c* of contact. Therefore, it is possible for the first portion 73*a* to pass by the rotational member 80, on the side toward which the rotational member 80 protrudes.

2) While the cartridge B is inserted into the apparatus main assembly A, the first portion 73*a* of contact passes the movable member 15, on the side of the portion 15*c* of contact, and disengages from the portion 15*c* of contact. Thereafter, when the second portion 73*b* of contact causes the movable member 15 to retreat into the non-protrusive position Z, the first portion 73*a* of contact is not in contact with the rotational member 80.

3) The movable member 15 has the flat surface 15*c*3, which is tilted in such an attitude that the upstream side of the flat surface 15*c*3 in terms of the cartridge insertion direction indicated by the arrow mark G1 is on the downstream side in terms of the direction, indicated by the arrow mark F, in which the movable member 15 is made to retreat.

4) The movable member 15 has the flat surface 15*c*1, which is tilted in such an attitude that its upstream side in terms of the direction, indicated by the arrow mark G1, in which the cartridge B is inserted into the apparatus main assembly A, is on the downstream side in terms of the direction, indicated by the arrow mark E, in which the movable member 15 protrudes.

5) The movable member 15 is disposed on the upstream side of the rotational member 18 in terms of the direction, indicated by the arrow mark G1, in which the cartridge B is inserted into the apparatus main assembly A.

6) The movable member 15 is kept pressed toward the protruding position Y by the elastic pressing means 17*a* and 17*b*.

The structure of the image forming apparatus main assembly A is as follows:

1) The image forming apparatus 100 in this embodiment is an apparatus for forming an image on a sheet P of recording medium, and employs a cartridge B which is removably installable in the apparatus main assembly A. The cartridge B is provided with a movable member 15 and a rotational member 80. The movable member 15 has a portion 15*c* which comes into contact with the counterpart of the apparatus main assembly A. It is movable between the protruding position Y and non-protruding position Z. The rotational member 80 is rotationally movable between the non-blocking position X1, in which it is when the movable member 15 is in the protruding position Y, and the blocking position X2, in which it is when the movable member 15 is in the non-protruding position Z. The apparatus main assembly A has the first and second portions 73*a* and 73*b* of contact.

As the cartridge B is inserted into the apparatus main assembly A, the first portion 73*a* of contact passes by the movable member 15, on the side, indicated by the arrow mark E, toward which the movable member 15 protrudes. Thereafter, the second portion 73*b* of contact separates from the protrusive portion 15*c*, and the first portion 73*a* of contact can pass by the rotational member 18, on the side toward which the rotational member 80 protrudes.

2) While the cartridge B is inserted into the apparatus main assembly A, the first portion 73*a* of contact passes by the movable member 15, on the side of the protrusive portion 15*c*, and disengages from the protrusive portion 15*c*. It is before the first portion 73*a* of contact disengage from the protrusive portion 15*c* that the second portion 73*b* comes into contact with the protrusive portion 15*c* and causes the movable member 15 into the non-protrusive position Z. Therefore, the first portion 73*a* of contact is not in contact with the rotational member 80.

3) The apparatus main assembly A has the guiding member 12L which guides the insertion-extraction bosses 72La and 72Lb, with which the cartridge B is provided, while the cartridge B is inserted into the apparatus main assembly A.

The structure of the system for preventing the erroneous insertion of the cartridge B is as follows.

The system is for preventing the cartridge B, which is removably installable in the main assembly A of the image forming apparatus 100 for forming an image on a sheet P of recording medium, from being erroneously inserted. The apparatus main assembly A has the first and second portions 73*a* and 73*b* of contact. The cartridge B has the movable member 15 and rotational member 80. The movable member 15 has the protrusive portion 15*c*, and is movable between the protrusive position Y, and the non-protrusive position Z. The rotational member 80 is movable between non-blocking position X1, in which it is when the movable member 15 is in the protrusive position Y, and the blocking position X2, in which it is when the movable member 15 is in the non-blocking position.

While the cartridge B is inserted into the apparatus main assembly A, it is after the first portion 73*a* of contact passes by the movable member 15, on the side, indicated by the arrow mark E, toward which the movable member 15 protrudes, that the second portion 73*b* of contact separated from the protrusive portion 15*c*. Therefore, the first portion 73*a* is allowed to pass by the rotational member 80, on the side toward which the rotational member 80 protrudes.

The effects of the second embodiment described above are the same as those obtainable by the first embodiment.

[Miscellanies]

1) The functions, materials, and shapes of the structural components of the image forming apparatuses in the preceding embodiments of the present invention, and the positional relationship among the structural components, are not intended to limit the present invention in scope, unless specifically noted.

2) The image forming apparatuses to which the present invention is applicable are not limited to the electrophotographic image forming apparatuses in the preceding embodiments. That is, they include image forming apparatuses which use various known image formation principles and methods, for example, an electrostatic recording process, a magnetic recording process, etc., other than the electrophotographic process.

3) The image forming apparatuses to which the present invention is applicable are not limited to image forming apparatuses which employs only a single cartridge. That is, they include image forming apparatuses which employ multiple cartridges (different in color of developer (toner) they contain, and removably installable in preset cartridge chambers), and form a color image, and the like.

4) The cartridges to which the present invention is applicable are not limited to those, in the preceding embodiments, of the so-called all-in-one type. They include also process cartridges of the so-called separation type, and development cartridges equipped with developing means for developing a latent image formed on an image bearing member. They include also units which are removably installable in the main assembly of an image forming apparatus and contributes to the process for forming an image on recording medium.

As will be evident from the detailed description of the embodiments of the present invention, the present invention makes it possible to place the system for preventing the problem that a cartridge is installed in an image forming apparatus which is incompatible with the cartridge, in the adjacencies of the cartridge entrance of an image forming apparatus. It can provide a reliable system for preventing the above described problem, regardless of combination between an image forming apparatus and a cartridge, which is simple in structure, does not affect an image forming apparatus in the length of its main assembly. That is, the present invention can provide a reliable system for preventing the problem that a cartridge is installed in an image forming apparatus incompatible with the cartridge, which is simply in structure, does not require the apparatus to be increased in length, and can inform a user whether or not a cartridge being installed in the apparatus is compatible with the apparatus, while the cartridge is still in the adjacencies of the cartridge entrance of the apparatus.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 210765/2012 filed Sep. 25, 2012, which is hereby incorporated by reference.

What is claimed is:

1. An image forming apparatus for forming an image on a recording material, wherein a cartridge is detachably mountable to said image forming apparatus, said image forming apparatus comprising:

a first movable member movable between a projection position in which said first movable member is in an insertion path of a contact portion provided on said cartridge when said cartridge is mounted to a main assembly of said image forming apparatus, and a retracted position in which said first movable member is retracted from the insertion path, wherein said first movable member moves from the projection position to the retracted position by being contacted by the contact portion; and a second movable member movable between an open position for permitting said cartridge toward downstream with respect to an inserting direction in which said cartridge is mounted to said main assembly and a blocking position for preventing said cartridge from moving toward the downstream by contacting said contact portion, said second movable member being interrelated with said first movable member so that when said first movable member is in the projection position, said second movable member takes the open position, and when said first movable member is in the retracted position, said second movable member takes the blocking position, wherein in the process of mounting said cartridge to said main assembly, said contact portion passes said first movable member in the inserting direction, and said first movable member moves from the retracted position to the projection position, and then said second movable member moves from the blocking position to the open position, and said contact portion passes said second movable member in the inserting direction.

2. An apparatus according to claim 1, wherein when an attempt is made to insert an improper cartridge to said image forming apparatus, said second movable member taking the blocking position contacts a contact portion provided on the improper cartridge before the contact portion of the improper cartridge passes said first movable member in the inserting direction.

3. An apparatus according to claim 1, wherein said first movable member is provided with an inclined surface inclined relative to the inserting direction, said inclined surface being contacted by the contact portion when said cartridge is mounted to said main assembly.

4. An apparatus according to claim 1, wherein said first movable member is provided with an inclined surface inclined relative to the inserting direction, said inclined surface being contacted by said contact portion when said cartridge is dismounted to said main assembly.

5. An apparatus according to claim 1, wherein said first movable member is disposed at a position upstream of said second movable member with respect to the inserting direction.

6. An apparatus according to claim 1, wherein said first movable member is urged in the projection position by urging means.

7. An apparatus according to claim 1, wherein said first movable member is movably provided on a guiding member for guiding said cartridge when said cartridge is mounted and demounted relative to said main assembly.

8. An apparatus according to claim 1, wherein said cartridge is mounted to said main assembly.

9. An apparatus according to claim 8, wherein said contact portion includes a first contact portion, provided at a downstream side with respect to the inserting direction, for moving said first movable member from the projection position to the retracted position by contacting said first movable member when said cartridge is mounted to said main assembly, and a second contact portion, provided at an upstream side with respect to the inserting direction, for moving said first movable member from the projection position to the retracted position by contacting said first movable member when said cartridge is mounted to said main assembly.

10. An apparatus according to claim 9, wherein said second contact portion is disposed at such a position as to permit movement of said first movable member from the retracted position to the projection position before said first contact position passes said second movable member.

11. An apparatus according to claim 10, wherein said cartridge is provided with a portion-to-be-guided for being guided by a guiding member provided in said main assembly when said cartridge is mounted and demounted relative to said main assembly.

12. An apparatus according to claim 11, wherein said contact portion is provided below said portion-to-be-guided when said cartridge is mounted to said main assembly.

13. A process cartridge detachably mountable to a main assembly of an image forming apparatus for forming an image on a recording material, wherein a cartridge is detachably mountable to the image forming apparatus, said main assembly of the image forming apparatus including, a first movable member movable between a projection position in which said first movable member is in an insertion path of a contact portion provided on said cartridge when said cartridge is mounted to said main assembly of said image forming apparatus, and a retracted position in which said first movable member is retracted from the insertion path, wherein said first movable member moves from the projection position to the retracted position by being contacted by said contact portion; and a second movable member movable between an open position for permitting said cartridge toward downstream with respect to an inserting direction in which said cartridge is mounted to said main assembly and a blocking position for preventing said cartridge from moving toward the downstream by contacting said contact portion, said second movable member being interrelated with said first movable member so that when said first movable member is in the projection position, said second movable member takes the open position, and when said first movable member is in the retracted position, said second movable member takes the blocking position;

said process cartridge comprising:

a contact portion contactable to said first movable member in the process of mounting said cartridge to said main assembly, wherein said contact portion passes said first movable member in the inserting direction, and said first movable member moves from the retracted position to the projection position, and then said second movable member moves from the blocking position to the open position, and said contact portion passes said second movable member in the inserting direction.

14. A cartridge according to claim 13, wherein said contact portion includes a first contact portion, provided at a downstream side with respect to the inserting direction, for moving said first movable member from the projection position to the retracted position by contacting said first movable member when said cartridge is mounted to said main assembly, and a second contact portion, provided at an upstream side with respect to the inserting direction, for moving said first movable member from the projection position to the retracted position by contacting said first movable member when said cartridge is mounted to said main assembly.

15. A cartridge according to claim 14, wherein said second contact portion is disposed at such a position as to permit movement of said first movable member from the retracted position to the projection position before said first contact position passes said second movable member.

16. A cartridge according to claim 13, wherein said cartridge is provided with a portion-to-be-guided for being guided by a guiding member provided in said main assembly when said cartridge is mounted and demounted relative to said main assembly.

17. A cartridge according to claim 16, wherein said contact portion is provided below said portion-to-be-guided when said cartridge is mounted to said main assembly.

18. An image forming apparatus system for forming an image on a recording material, said image forming apparatus system comprising:

(i) a first cartridge;

(ii) a first image forming apparatus for forming an image on a recording material, wherein said first cartridge is detachably mountable to said first image forming apparatus, said first image forming apparatus including a first movable member movable between a projection position in which said first movable member is in an insertion path of a first contact portion provided on said first cartridge when said first cartridge is mounted to a first main assembly of said first image forming apparatus, and a retracted position in which said first movable member is retracted from the insertion path, wherein said first movable member moves from the projection position to the retracted position by being contacted by said first contact portion; a second movable member movable between an open position for permitting said first cartridge toward downstream with respect to an inserting direction in which said first cartridge is mounted to said first main assembly and a blocking position for preventing said first cartridge from moving toward the downstream by contacting said first contact portion, said second movable member being interrelated with said first movable member so that when said first movable member is in the projection position, said second movable member takes the open position, and when said first movable member is in the retracted position, said second movable member takes the blocking position; wherein in the process of mounting said first cartridge to said first main assembly, said first contact portion passes said first movable member in the inserting direction, and said first movable member moves from the retracted position to the projection position, and then said second movable member moves from the blocking position to the open position, said first contact portion passes said second movable member in the inserting direction;

(iii) a second cartridge; and (iv) a second image forming apparatus for forming an image on a recording material, wherein said second cartridge is detachably mountable to said second image forming apparatus, said second image forming apparatus including a third movable member movable between a projection position in which said third movable member is in an insertion path of a second contact portion provided on said second cartridge when said second cartridge is mounted to a second main assembly of said second image forming apparatus, and a retracted position in which said third movable member is retracted from the insertion path, wherein said third movable member moves from the projection position to the retracted position by being contacted by the second contact portion; a fourth movable member movable between an open position for permitting said second cartridge toward downstream with respect to an inserting direction in which said second cartridge is mounted to said second main assembly and a blocking position for preventing said second cartridge from moving toward the downstream by contacting said second contact portion, said fourth movable member being interrelated with said third movable member so that when said third movable member is in the projection position, said fourth movable member takes the open position, and when said third movable member is in the retracted position, said fourth movable member takes the blocking position; wherein in the process of mounting said second cartridge to said second main assembly, said second contact portion passes said third movable member in the inserting direction, and said third movable member moves from the retracted position to the projection position, and then said fourth movable member moves from the blocking position to the open position, said second contact portion passes said fourth movable member in the inserting direction, wherein when said second cartridge is mounted to said first image forming apparatus, said second movable member taking the blocking position contacts said contact portion before said second contact portion passes said first movable member in the inserting direction, and when said first cartridge is mounted to said second image forming apparatus, said fourth movable member taking the blocking position contacts said contact portion before said first contact portion passes said third movable member in the inserting direction.

19. An image forming apparatus system according to claim 18, wherein said first contact portion includes a first downstream contact portion provided in a downstream side with respect to the inserting direction, and a first upstream contact portion provided in an upstream side with respect to the inserting direction, and said second contact portion includes a second downstream contact portion provided in a downstream side with respect to the inserting direction, and a second upstream contact portion provided in an upstream side with respect to the inserting direction, wherein a first distance between the first downstream contact portion and said first upstream contact portion is different from a second distance between the second downstream contact portion and the second upstream contact portion.

20. An image forming apparatus system according to claim 19, wherein the second distance is such that said third movable member moves to the projected position between said second downstream contact portion and said second upstream contact portion.

* * * * *